US008641468B2

(12) United States Patent
Tanaka et al.

(10) Patent No.: US 8,641,468 B2
(45) Date of Patent: Feb. 4, 2014

(54) MANUFACTURING METHOD FOR SPARK PLUG

(75) Inventors: Tomoyuki Tanaka, Nagoya (JP); Kouji Okazaki, Nagoya (JP)

(73) Assignee: NGK Spark Plug., Ltd., Aichi (JP)

( * ) Notice: Subject to any disclaimer, the term of this patent is extended or adjusted under 35 U.S.C. 154(b) by 0 days.

(21) Appl. No.: 13/977,931

(22) PCT Filed: Jan. 20, 2012

(86) PCT No.: PCT/JP2012/000340

§ 371 (c)(1),
(2), (4) Date: Jul. 2, 2013

(87) PCT Pub. No.: WO2012/098905

PCT Pub. Date: Jul. 26, 2012

(65) Prior Publication Data

US 2013/0280980 A1 Oct. 24, 2013

(30) Foreign Application Priority Data

Jan. 20, 2011 (JP) ..... 2011-009746

(51) Int. Cl.
*H01T 21/02* (2006.01)

(52) U.S. Cl.
USPC ..... 445/7; 313/141; 313/142

(58) Field of Classification Search
USPC ..... 445/7; 313/141, 142
See application file for complete search history.

(56) References Cited

U.S. PATENT DOCUMENTS

| | | | | |
|---|---|---|---|---|
| 5,556,315 | A | 9/1996 | Kagawa | 445/7 |
| 6,285,008 | B1 * | 9/2001 | Fleetwood et al. | 219/270 |
| 6,750,597 | B1 * | 6/2004 | Sakura | 313/141 |
| 2003/0062815 | A1 * | 4/2003 | Kanao et al. | 313/141 |
| 2005/0042965 | A1 | 2/2005 | Oda et al. | 445/7 |
| 2006/0276097 | A1 * | 12/2006 | Suzuki et al. | 445/7 |
| 2009/0322198 | A1 * | 12/2009 | Kameda et al. | 313/141 |

FOREIGN PATENT DOCUMENTS

| | | | |
|---|---|---|---|
| JP | 5-277746 | 10/1993 | B34K 11/11 |
| JP | 7-22154 | 1/1995 | H01T 13/20 |
| JP | 7-022157 | 1/1995 | H01T 13/20 |
| JP | 2003-205372 | 7/2003 | B23K 11/24 |
| JP | 2005-63893 | 3/2005 | H01T 13/20 |
| JP | 2005-158323 | 6/2005 | H01T 13/20 |
| JP | 2007-80842 | 3/2007 | H01T 13/20 |

OTHER PUBLICATIONS

International Search Report for International Application No. PCT/JP2012/000340, Apr. 24, 2012.

* cited by examiner

*Primary Examiner* — Mary Ellen Bowman
(74) *Attorney, Agent, or Firm* — Kusner & Jaffe

(57) ABSTRACT

A method of manufacturing a spark plug includes a joining step of joining a first member and a second member which constitute the spark plug. In the joining step, a first welding electrode in contact with the first member and a second welding electrode which has an elastically deformable intermediate portion and which is in contact with the second member are electrically connected through the first member and the second member, whereby the first member and the second member are joined together by resistance welding.

16 Claims, 11 Drawing Sheets

(a)

(b)

MANUFACTURING METHOD FOR SPARK PLUG

FIELD OF THE INVENTION

The present invention relates to a method of manufacturing a spark plug.

BACKGROUND OF THE INVENTION

In general, a spark plug used for igniting an internal combustion engine such as a gasoline engine includes a center electrode, an insulator provided around the center electrode, a metallic shell provided around the insulator, and a ground electrode (also called "outer electrode") which is attached to the metallic shell and forms a spark discharge gap in cooperation with the center electrode.

There has been known a spark plug in which an electrode tip made of a noble metal such as platinum or iridium is joined to a spark discharge portion of the ground electrode so as to improve the resistance to spark erosion and the resistance to oxidation erosion. The electrode tip is joined to the ground electrode by means of resistance welding. Specifically, in a state in which one end portion (base end portion) of the ground electrode is joined to a forward end portion of the metallic shell, the other end portion (distal end portion) of the ground electrode and the electrode tip are sandwiched from opposite sides by the forward end surfaces of two welding electrodes so as to apply a pressure thereto. In such a state, a voltage is applied between the welding electrodes, whereby the ground electrode and the electrode tip are welded together (see, for example, Japanese Patent Application Laid-Open (kokai) No. H7-22157 "Patent Document 1"). Also, the ground electrode is joined to the metallic shell by means of resistance welding. Specifically, the metallic shell is supported by one welding electrode, and the ground electrode is chucked by the other welding electrode. The ground electrode and the metallic shell are sandwiched between the two welding electrodes so as to apply a pressure thereto. In such a state, a voltage is applied between the welding electrodes, whereby the ground electrode and the metallic shell are welded together.

SUMMARY OF THE INVENTION

Problem to be Solved by the Invention

Conventionally, when resistance welding is performed for joining of first and second members which constitute a spark plug (e.g., joining the electrode tip to the ground electrode or joining the ground electrode to the metallic shell), a stable pressing state cannot be established due to, for example, a dimensional variation or positional variation of each component. Therefore, in some cases, welding may be performed under an unstable condition, which may lower joint strength.

The present invention was made so as to solve the above-described problem, and its object is to restrain lowering of the joint strength between first and second members which are joined together by means of resistance welding in a process of manufacturing a spark plug.

Means for Solving the Problem

To solve, at least partially, the above problem, the present invention can be embodied in the following modes or application examples.

Application Example 1

A method of manufacturing a spark plug which includes a center electrode, a metallic shell, and a ground electrode having one end portion joined to a forward end portion of the metallic shell, the method comprising:

a joining step of joining a first member and a second member which constitute the spark plug, wherein, in the joining step, a first welding electrode in contact with the first member and a second welding electrode which has an elastically deformable intermediate portion and which is in contact with the second member are electrically connected through the first member and the second member, whereby the first member and the second member are joined together by resistance welding.

In this method, since the second welding electrode has an intermediate portion which is elastically deformable along the facing direction, even in the case where each component has a dimensional variation or a positional variation, the state in which the first welding electrode in contact with the first member and the second welding electrode in contact with the second member are electrically connected through the first and second members can be stably established. Therefore, in this method, the welding for joining the first and second members can be performed under a stable condition, whereby lowering of joint strength can be suppressed.

Application Example 2

A method of manufacturing a spark plug according to application example 1, comprising:

a step of acquiring, from positional information of the second member, a correction value for rendering constant a load applied for the resistance welding; and a step of adjusting the load applied for the resistance welding by use of the correction value, In this method, a correction value for rendering constant the load applied for the resistance welding is acquired from the positional information of the second member, and the load applied for the resistance welding is adjusted by use of the correction value. Therefore, the load applied to the first and second members at the time of the resistance welding can be made constant, whereby lowering of joint strength can be suppressed satisfactorily.

Application Example 3

A method of manufacturing a spark plug according to application example 1 or 2, wherein the first member is the ground electrode, and the second member is an electrode tip which is joined to the ground electrode and forms a gap in cooperation with the center electrode;

the first welding electrode has a first forward end surface for supporting a surface of the ground electrode opposite the side to which the electrode tip is to be joined;

the second welding electrode has a second forward end surface which faces the first forward end surface and has the intermediate portion provided rearward of the second forward end surface such that the intermediate portion is elastically deformable along a facing direction in which the first forward end surface and the second forward end surface face each other; and the joining step is a step of joining the ground electrode and the electrode tip by resistance welding after sandwiching the ground electrode and the electrode tip between the first welding electrode and the second welding electrode.

In this method, the second welding electrode has an intermediate portion which is elastically deformable along the facing direction. Therefore, even in the case where each component has a dimensional variation or a positional variation, when the ground electrode and the electrode tip are sandwiched between the first welding electrode and the second welding electrode, the electrode tip comes into contact with both of the second forward end surface of the second welding electrode and the surface of the ground electrode, and a pressing state in which the second forward end surface of the second welding electrode presses the electrode tip against the surface of the ground electrode can be stably established. Therefore, according to this method, in the resistance welding performed for joining the electrode tip to the ground electrode in the process of manufacturing the spark plug, lowering of joint strength can be suppressed.

Application Example 4

A method of manufacturing a spark plug according to application example 3, wherein the joining step comprises a step of moving the second welding electrode toward the ground electrode after the surface of the ground electrode opposite the side to which the electrode tip is to be joined is supported by the first forward end surface of the first welding electrode, whereby the ground electrode and the electrode tip are sandwiched between the first welding electrode and the second welding electrode.

In this method, a stable pressing state can be established easily and reliably, whereby lowering of joint strength can be suppressed.

Application Example 5

A method of manufacturing a spark plug according to application example 3 or 4, wherein the joining step comprises:

a step of measuring a first distance along the facing direction between a predetermined reference point and the surface of the ground electrode opposite the side to which the electrode tip is to be joined;

a step of acquiring a second distance along the facing direction between the predetermined reference point and the first forward end surface of the first welding electrode;

a step of moving the first welding electrode toward the ground electrode along the facing direction by an amount equal to the difference between the second distance and the first distance;

a step of moving the second welding electrode toward the ground electrode along the facing direction by a predetermined moving amount which is sufficiently large to establish a contact state in which the electrode tip is in contact with both of the second forward end surface of the second welding electrode and the ground electrode and to cause the intermediate portion of the second welding electrode to elastically deform so as to establish a pressing state in which the second forward end surface presses the electrode tip against the ground electrode; and a step of applying a voltage between the first welding electrode and the second welding electrode in the pressing state, to thereby weld the electrode tip and the ground electrode together.

In this method, the first forward end surface of the first welding electrode moves to a position which perfectly coincides with a surface of the ground electrode opposite the side to which the electrode tip is to be joined, and the first forward end surface supports the opposite surface of the ground electrode without pressing the ground electrode along the facing direction. Therefore, in this method, when resistance welding is performed, there can be established a state in which almost the entirety of the first forward end surface of the first welding electrode is in contact with the surface of the ground electrode, and almost the entirety of the surface of the electrode tip is in contact with the surface of the ground electrode, whereby the state of contact between the ground electrode and the electrode tip and the forward end surfaces of the welding electrodes becomes stable. Therefore, according to this method, in the resistance welding performed for joining the electrode tip to the ground electrode in the process of manufacturing the spark plug, the welding condition can be stabilized, whereby lowering of joint strength can be suppressed.

Application Example 6

A method of manufacturing a spark plug according to application example 5, wherein the step of moving the second welding electrode comprises a step of reducing a moving speed of the second welding electrode immediately before establishment of the contact state.

This method can suppress formation of a dent on the surface of the ground electrode while suppressing an increase in the time required for the manufacturing process. Therefore, the state of contact between the ground electrode and the electrode tip at the time of resistance welding can be stabilized, whereby lowering of joint strength can be suppressed.

Application Example 7

A method of manufacturing a spark plug according to application example 5 or 6, wherein the joining step further comprises a step of measuring a third distance along the facing direction between the predetermined reference point and the second forward end surface of the second welding electrode;

the intermediate portion of the second welding electrode has a support portion which is adjacently provided on the side opposite the second forward end surface; and the step of moving the second welding electrode is a step of moving the support portion by a moving amount which is obtained by adding to the difference between the first distance and the third distance a moving amount corresponding to a target deformation amount of the intermediate portion in the pressing state.

In this method, the deformation amount of the intermediate portion of the second welding electrode in the pressing state can be rendered constant, whereby the compression force in the pressing state can be rendered constant. Therefore, in this method, the compression force at the time of resistance welding the ground electrode and the electrode tip together can be rendered constant, whereby the welding condition can be stabilized further, and lowering of joint strength can be suppressed satisfactorily. Notably, in the present application example, the step of measuring the third distance corresponds to the step of acquiring the correction value, which is used for rendering constant the load for resistance welding the first member and the second member together, from the positional information of the second member. Also, the step of moving the second welding electrode by a moving amount set on the basis of the third distance corresponds to the step of adjusting the load for resistance welding by use of the correction value (such that the load becomes constant).

Application Example 8

A method of manufacturing a spark plug according to application example 7, wherein the joining step further comprises a step of acquiring dimensions of the ground electrode and the electrode tip along the facing direction; and the step of moving the second welding electrode comprises a step of adjusting the moving amount on the basis of the dimensions.

In this method, even in the case where various types of products are manufactured, the compression force at the time of resistance welding the ground electrode and the electrode tip together can be rendered constant easily so as to render the welding condition more stable, whereby lowering of joint strength can be suppressed satisfactorily. Notably, in the present application example, the step of acquiring the dimensions corresponds to the step of acquiring the correction value, which is used for rendering constant the load for resistance welding the first member and the second member together, from the positional information of the second member. Also, the step of adjusting the moving amount of the second welding electrode on the basis of the dimensions corresponds to the step of adjusting the load for resistance welding by use of the correction value (such that the load becomes constant).

Application Example 9

A method of manufacturing a spark plug according to application example 7 or 8, wherein the joining step further comprises a step of monitoring a pressing force acting on the ground electrode and the electrode tip at the time of the welding, and a step of, when the compression force changes, moving the second welding electrode along the facing direction by a moving amount for compensating a change in the compression force.

In this method, the compression force at the time of resistance welding the ground electrode and the electrode tip together can be rendered constant with high accuracy, whereby the welding condition can be stabilized further, and lowering of joint strength can be suppressed satisfactorily.

Application Example 10

A method of manufacturing a spark plug according to application example 1 or 2, wherein the first member is the metallic shell, and the second member is the ground electrode;

the first welding electrode supports the metallic shell on the side opposite the side to which the ground electrode is to be joined;

the second welding electrode chucks the ground electrode at a side surface thereof; and the joining step is a step in which the first welding electrode and the second welding electrode are electrically connected through the metallic shell and the ground electrode, whereby the metallic shell and the ground electrode are joined by resistance welding.

In this method, even in the case where each component has a dimensional variation or a positional variation, a pressing state in which the ground electrode chucked by the second welding electrode is pressed against the metallic shell supported by the first welding electrode can be stably established. Therefore, the resistance welding for joining the metallic shell and the ground electrode can be performed under a stable condition, whereby lowering of joint strength can be suppressed.

Application Example 11

A method of manufacturing a spark plug according to application example 10, wherein the joining step comprises a step of moving the second welding electrode, which chucks the ground electrode, toward the metallic shell supported by the first welding electrode, whereby the metallic shell and the ground electrode are sandwiched between the first welding electrode and the second welding electrode.

In this method, a stable pressing state can be established easily and reliably, whereby lowering of joint strength can be suppressed.

Application Example 12

A method of manufacturing a spark plug according to application example 10 or 11, wherein the intermediate portion of the second welding electrode has a support portion which is adjacently provided on the side opposite a portion for chucking the ground electrode; and the joining step comprises:

a step of measuring a fourth distance between a predetermined reference point and a surface of the metallic shell to which the ground electrode is to be joined, the fourth distance being measured along a facing direction in which the ground electrode and the metallic shell face each other;

a step of acquiring a fifth distance along the facing direction between the predetermined reference point and a predetermined reference position on the second welding electrode;

a step of moving the second welding electrode toward the metallic shell along the facing direction such that the support portion moves by a moving amount set on the basis of the difference between the fourth distance and the fifth distance; and a step of applying a voltage between the first welding electrode and the second welding electrode after the movement of the second welding electrode, to thereby weld the metallic shell and the ground electrode together.

In this method, the second welding electrode is moved toward the metallic shell such that the support portion moves by a moving amount set on the basis of the difference between the fourth distance and the fifth distance, and the metallic shell and the ground electrode are joined together through application of a voltage between the first welding electrode and the second welding electrode. Therefore, a pressing state in which the second welding electrode presses the ground electrode against the metallic shell can be established more reliably, whereby lowering of joint strength can be suppressed. Notably, in the present application example, the step of acquiring the fifth distance corresponds to the step of acquiring the correction value, which is used for rendering constant the load for resistance welding the first member and the second member together, from the positional information of the second member. Also, the step of moving the second welding electrode by a moving amount set on the basis of the fifth distance corresponds to the step of adjusting the load for resistance welding by use of the correction value (such that the load becomes constant).

Application Example 13

A method of manufacturing a spark plug according to application example 12, wherein the joining step comprises a step of measuring a sixth distance along the facing direction between the predetermined reference position on the second welding electrode and a forward end surface of the ground electrode chucked by the second welding electrode; and the moving amount is set on the basis of a value obtained by subtracting the sixth distance from the difference between the fourth distance and the fifth distance.

In this method, irrespective of variation of the length of the ground electrode or variation of the chucking position of the second welding electrode at which the ground electrode is chucked by the second welding electrode, there can be more stably established a state in which the first welding electrode and the second welding electrode are electrically connected through the metallic shell, and the ground electrode, and the second welding electrode presses the ground electrode against the metallic shell. Therefore, lowering of joint strength can be suppressed. Notably, in the present application example, the step of acquiring the sixth distance corresponds to the step of acquiring the correction value, which is used for rendering constant the load for resistance welding the first member and the second member together, from the positional information of the second member. Also, the step of moving the second welding electrode by a moving amount set on the basis of the sixth distance corresponds to the step of adjusting the load for resistance welding by use of the correction value (such that the load becomes constant).

Application Example 14

A method of manufacturing a spark plug according to application example 13, wherein the moving amount is sufficiently large to establish a contact state in which the ground electrode chucked by the second welding electrode is in contact with the metallic shell and to cause the intermediate portion of the second welding electrode to elastically deform so as to establish a pressing state in which the second welding electrode presses the ground electrode against the metallic shell.

In this method, the pressing state in which the second welding electrode presses the ground electrode against the metallic shell can be established more reliably, whereby lowering of joint strength can be suppressed.

Application Example 15

A method of manufacturing a spark plug according to application example 14, wherein the step of moving the second welding electrode comprises a step of reducing a moving speed of the second welding electrode immediately before establishment of the contact state.

This method can suppress formation of a dent on the surface of the metallic shell or the ground electrode while suppressing an increase in the time required for the manufacturing process. Therefore, the state of contact between the metallic shell and the ground electrode at the time of resistance welding can be stabilized, whereby lowering of joint strength can be suppressed.

Application Example 16

A method of manufacturing a spark plug according to application example 14 or 15, wherein the step of moving the second welding electrode is a step of moving the support portion by a moving amount which is obtained by subtracting the sixth distance from the difference between the fourth distance and the fifth distance and adding to the resultant value a moving amount corresponding to a target deformation amount of the intermediate portion in the pressing state.

In this method, the deformation amount of the intermediate portion of the second welding electrode in the pressing state can be rendered constant, whereby the compression force in the pressing state can be rendered constant. Therefore, the compression force at the time of resistance welding the metallic shell and the ground electrode together can be rendered constant, whereby the welding condition can be stabilized further, and lowering of joint strength can be suppressed satisfactorily.

Application Example 17

A method of manufacturing a spark plug according to application example 16, wherein the joining step further comprises a step of monitoring a pressing force acting on the metallic shell and the ground electrode at the time of the welding, and a step of, when the compression force changes, moving the second welding electrode along the facing direction by a moving amount for compensating a change in the compression force.

In this method, the compression force at the time of resistance welding the metallic shell and the ground electrode together can be rendered constant with high accuracy, whereby the welding condition can be stabilized further, and lowering of joint strength can be suppressed satisfactorily.

Notably, the present invention can be implemented in various modes. For example, the present invention can be implemented in the form of a method or apparatus for manufacturing a spark plug, a method or apparatus for joining an electrode tip to a ground electrode of a spark plug, or the like.

DETAILED DESCRIPTION OF THE INVENTION

Embodiments of the present invention will now be described in the following order.

A. First Embodiment:

A-1. Structure of a Spark Plug:

A-2. Method of Manufacturing the Spark Plug:

A-3. Method of Joining an Electrode Tip to a Ground Electrode:

A-4. Method of Joining a Ground Electrode to a Metallic Shell:

B. Second Embodiment:

C. Third Embodiment:

D. Fourth Embodiment:

E. Fifth Embodiment:

F. Modifications:

A. First Embodiment

Figure 1:
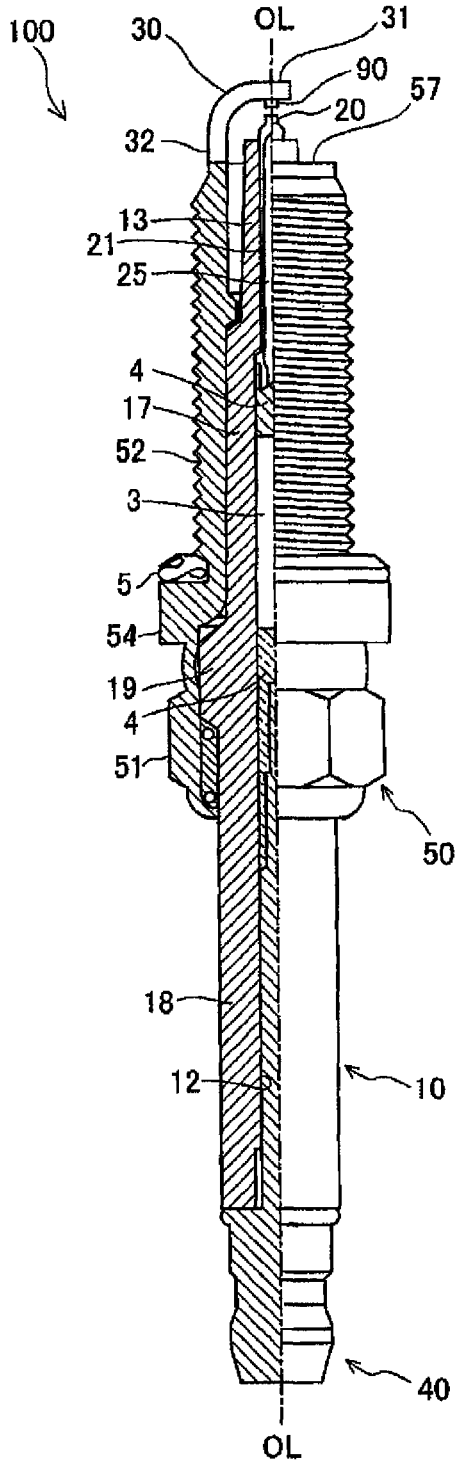
FIG. 1 is an explanatory view showing the structure of a spark plug 100 in a first embodiment of the present invention.

A-1. Structure of a Spark Plug:

FIG. 1 is an explanatory view showing the structure of a spark plug 100 in a first embodiment of the present invention. In FIG. 1, a side view of the spark plug 100 is shown on the right side of an axis OL, which is the center axis of the spark plug 100, and a cross-sectional view of the spark plug 100 is shown on the left side of the axis OL. In the following description, the upper side of FIG. 1 (the side where a ground electrode 30 is disposed) as viewed along the axis OL of the spark plug 100 will be referred to the forward end side of the spark plug 100, and the lower side of FIG. 1 (the side where a metallic terminal 40 is disposed) as viewed along the axis OL will be referred to as the rear end side of the spark plug 100.

As shown in FIG. 1, the spark plug 100 includes a ceramic insulator 10, a center electrode 20, a ground electrode (outer electrode) 30, a metal terminal 40, and a metallic shell 50. The center electrode 20 is held by the ceramic insulator 10, and the ceramic insulator 10 is held by the metallic shell 50. The ground electrode 30 is attached to the forward end of the metallic shell 50, and the metallic terminal 40 is attached to the rear end of the ceramic insulator 10.

The ceramic insulator 10 is a tubular insulator having, at its center, an axial hole 12 in which the center electrode 20 and the metallic terminal 40 are accommodated. The ceramic insulator 10 is formed by firing a ceramic material such as alumina. The ceramic insulator 10 has a center trunk portion 19 which is formed in the vicinity of the center in the axial direction and which is larger in outer diameter than the remaining portion. A rear trunk portion 18 is formed on the rear end side of the center trunk portion 19 so as to provide electrical insulation between the metallic terminal 40 and the metallic shell 50. A forward trunk portion 17 is formed on the forward end side of the center trunk portion 19, and a leg portion 13 which is smaller in outer diameter than the forward trunk portion 17 is formed on the forward end side of the forward trunk portion 17.

The metallic shell 50 is a generally cylindrical metallic member which surrounds and holds a portion of the ceramic insulator 10, which portion extends from a position on the rear trunk portion 18 to the leg portion 13. The metallic shell 50 is made of a metal such as low-carbon steel. The metallic shell 50 has a generally cylindrical screw portion 52. A screw thread is formed on the side surface of the screw portion 52. When the spark plug 100 is attached to an engine head, the screw thread comes into screw engagement with a threaded hole of the engine head. A forward end surface 57 of the metallic shell 50, which is an end surface thereof located on the forward end side, defines a circular opening, and a forward end of the leg portion 13 of the ceramic insulator 10 projects through the circular opening. The metallic shell 50 also has a tool engagement portion 51 and a seal portion 54. When the spark plug 100 is attached to the engine head, a tool is fitted onto the tool engagement portion 51. The seal portion 54 is formed on the rear end side of the screw portion 52 and has a flange-like shape. An annular gasket 5 formed by bending a plate member is interposed between the seal portion 54 and the engine head. The tool engagement portion 51 has a hexagonal cross section, for example.

The center electrode 20 is a rodlike electrode which is composed of a covering member 21 formed into the shape of a tube with a bottom, and a core member 25 which is disposed inside the covering member 21 and which is higher in thermal conductivity than the covering member 21. In the present embodiment, the covering member 21 is made of a nickel alloy containing nickel as a main component, and the core member 25 is made of copper or an alloy containing copper as a main component. The center electrode 20 is accommodated within the axial hole 12 of the ceramic insulator 10 such that a forward end portion of the covering member 21 projects from the axial hole 12 of the leg portion 13 of the ceramic insulator 10. The center electrode 20 is electrically connected via a ceramic resistor 3 and seals 4 to the metallic terminal 40 provided at the rear end of the ceramic insulator 10.

The ground electrode 30 is a rodlike bent electrode. In the present embodiment, the ground electrode 30 is also composed of two layers as in the case of the center electrode 20. Namely, the ground electrode 30 is composed of a covering member made of a nickel alloy containing nickel as a main component, and a core member made of copper or an alloy containing copper as a main component. A base end portion 32 of the ground electrode 30, which is one end portion thereof, is joined to the forward end surface 57 of the metallic shell 50, and a distal end portion 31 of the ground electrode 30, which is the other end portion thereof, is bent such that the distal end portion 31 faces the forward end portion of the center electrode 20. An electrode tip 90 is joined to a side of the distal end portion 31 of the ground electrode 30, which side faces the center electrode 20, whereby a gap for spark discharge (spark gap) is formed between the electrode tip 90 and the forward end of the center electrode 20. The electrode tip 90, which is provided on the ground electrode 30 for the purpose of, for example, enhancing spark erosion resistance and oxidation erosion resistance, contains noble metal having a high melting point as a main component. For example, the electrode tip 90 is made of iridium (Ir) or an Ir alloy which contains Ir as a main component and to which at least one of platinum (Pt), rhodium (Rh), ruthenium (Ru), palladium (Pd), and rhenium (Re) is added. Ir-5Pt alloy (iridium alloy containing platinum in an amount of 5% by mass) is widely used.

Figure 2:
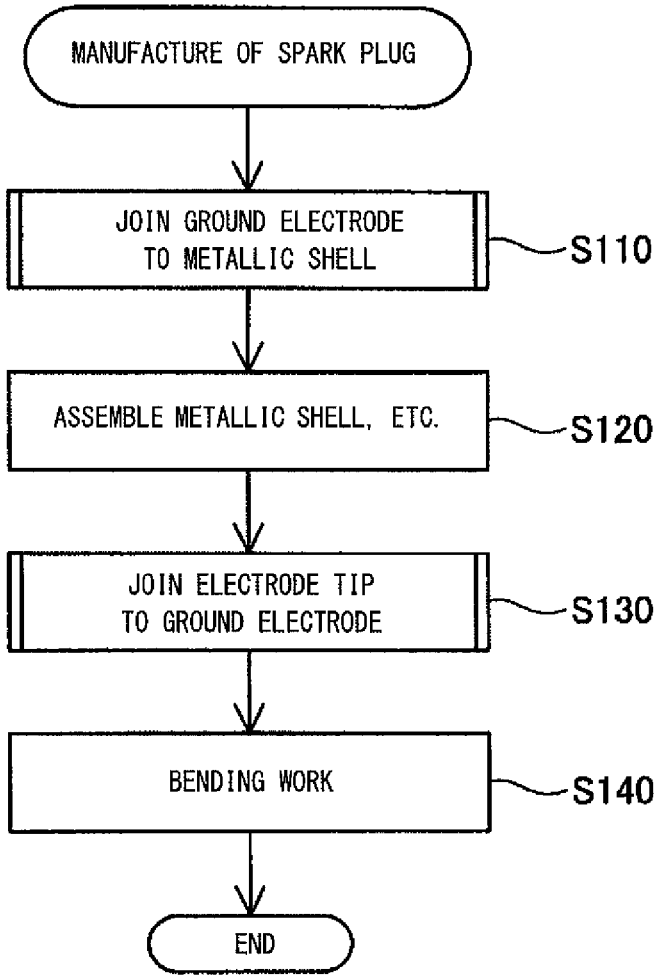
FIG. 2 is a flowchart showing a method of manufacturing the spark plug 100 in the present embodiment.

A-2. Method of Manufacturing the Spark Plug:

FIG. 2 is a flowchart showing a method of manufacturing the spark plug 100 in the present embodiment. When the spark plug 100 is manufactured, first, the base end portion 32 of the ground electrode 30 is joined to the forward end surface 57 of the metallic shell 50 (step S110). This joining is performed by means of, for example, welding. Notably, at the time of joining, the ground electrode 30 has not yet been bent, and is generally straight. A method of joining the ground electrode 30 to the metallic shell 50 will be described in detail later.

Next, components (the metallic shell 50 having the ground electrode 30 joined thereto, the center electrode 20, etc.) of the spark plug 100 are assembled together (step S120). Since a typical method of assembling these components is well known, the method will not be described in detail here.

Next, the electrode tip 90 is joined to the distal end portion 31 of the ground electrode 30 joined to the metallic shell 50 (step S130). A method of joining the electrode tip 90 to the ground electrode 30 will be described in detail later. After joining of the electrode tip 90 to the ground electrode 30, the ground electrode 30 is bent (step S140). This bending work is a process of bending the generally straight ground electrode 30 such that a spark gap is formed between the electrode tip 90 joined to the distal end portion 31 of the ground electrode 30 and the forward end portion of the center electrode 20. Thus, manufacture of the spark plug 100 of the present embodiment shown in FIG. 1 is completed.

Figure 3:
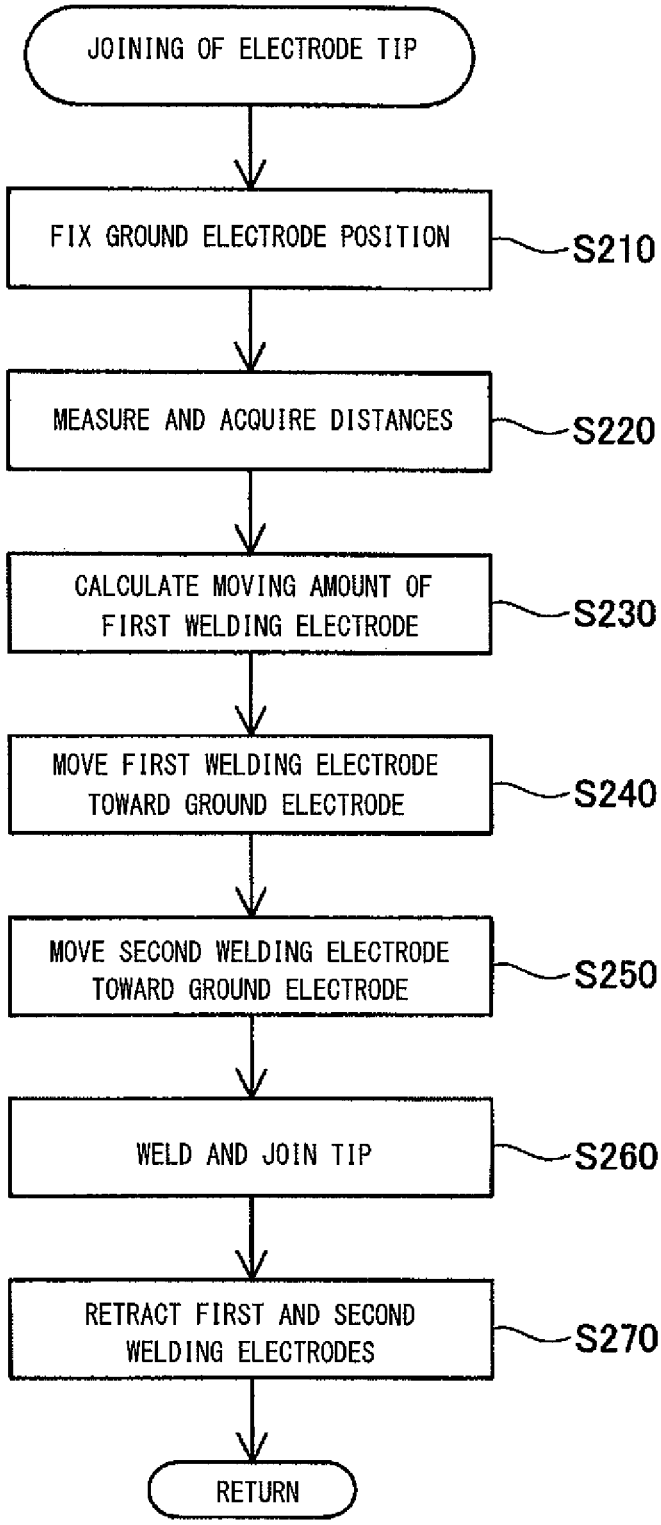
FIG. 3 is a flowchart showing a method of joining an electrode tip 90 to a ground electrode 30 in the present embodiment.
Figure 4:
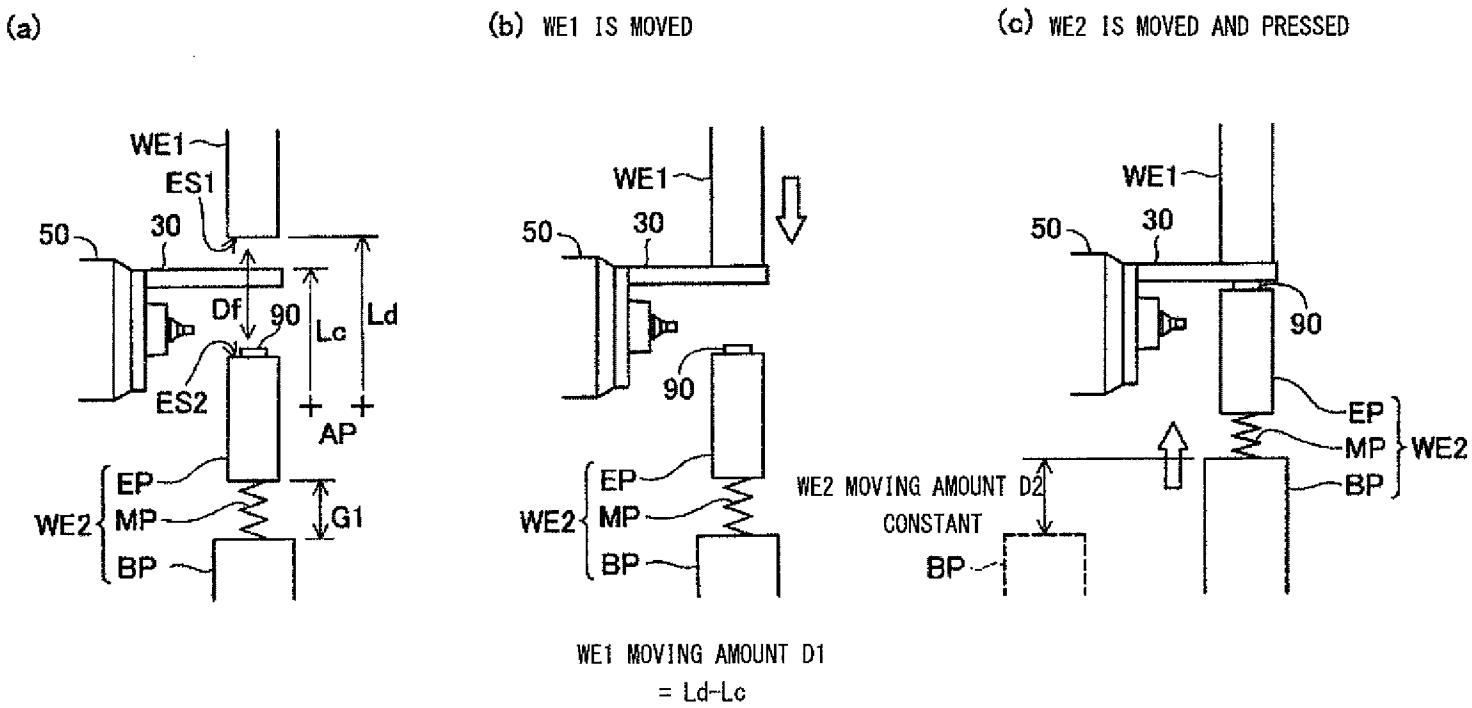
FIG. 4 illustrates explanatory views showing the method of joining the electrode tip 90 to the ground electrode 30 in the present embodiment.

A-3. Method of Joining the Electrode Tip to the Ground Electrode:

FIG. 3 is a flowchart showing a method of joining the electrode tip 90 to the ground electrode 30 in the present embodiment. FIG. 4 is a set of explanatory views showing the method of joining the electrode tip 90 to the ground electrode 30 in the present embodiment. Notably, in the process of joining the electrode tip 90 to the ground electrode 30, the ground electrode 30 corresponds to the first member of the present invention, and the electrode tip 90 corresponds to the second member of the present invention.

When the electrode tip 90 is joined to the ground electrode 30, first, the position of the ground electrode 30 is fixed (step S210). Since the ground electrode 30 has been joined to the metallic shell 50, the position of the ground electrode 30 is fixed when the metallic shell 50 is fixedly held. Notably, the ground electrode 30 itself may be fixedly held.

In the present embodiment, the electrode tip 90 is joined to the ground electrode 30 by means of resistance welding which is performed using a pair of welding electrodes (a first welding electrode WE1 and a second welding electrode WE2) (see FIG. 4(*a*)). The first welding electrode WE1 and the second welding electrode WE2 are disposed such that the forward end surface (first forward end surface ES1) of the first welding electrode WE1 and the forward end surface (second forward end surface ES2) of the second welding electrode WE2 face each other. The direction in which these forward end surfaces face each other (namely, a direction approximately perpendicular to the first forward end surface ES1 and the second forward end surface ES2) will be referred to as the "facing direction Df." The second welding electrode WE2 includes a forward end portion EP having the second forward end surface ES2; a support portion BP; and an intermediate portion MP which is located between the forward end portion EP and the support portion BP and is elastically deformable along the facing direction Df. The first welding electrode WE1 and the second welding electrode WE2 can reciprocate along the facing direction Df. Notably, in the following description, the moving amount D2 of the second welding electrode WE2 refers to the moving amount of the support portion BP of the second welding electrode WE2.

In the present embodiment, as shown in FIG. 4(*a*), the facing direction Df is approximately parallel to the vertical direction; and the first welding electrode WE1 is located on the upper side, and the second welding electrode WE2 is located on the lower side. In an initial state before the ground electrode 30 is fixedly held, a space is formed between the first forward end surface ES1 of the first welding electrode WE1 and the second forward end surface ES2 of the second welding electrode WE2, and the electrode tip 90 to be joined to the ground electrode 30 is disposed on the second forward end surface ES2 of the second welding electrode WE2. Also, the intermediate portion MP has a predetermined length G1 as measured along the facing direction Df. The fixing of the ground electrode 30 (step S210 of FIG. 3) is performed such that a region of the ground electrode 30 to which the electrode tip 90 is to be joined is located within the above-mentioned space and faces the electrode tip 90 disposed on the second forward end surface ES2. Notably, the electrode tip 90 may be disposed on the second forward end surface ES2 after fixing of the ground electrode 30.

After fixing of the ground electrode 30, as shown in FIG. 4(*a*), a first distance Lc (along the facing direction Df) between a preset reference point AP and a surface (hereinafter also referred to as the "outer surface") of the ground electrode 30 opposite the side to which the electrode tip 90 is to be joined is measured, and a second distance Ld (along the facing direction Df) between the reference point AP and the first forward end surface ES1 of the first welding electrode WE1 is acquired (step S220). The reference point AP is arbitrarily set. The second distance Ld is measured at the beginning of a manufacturing process and is stored in a predetermined storage area. The second distance Ld is acquired by reading out the stored second distance Ld. However, the second distance Ld may be acquired by measuring it every time. Notably, measurement of the first and second distances Le and Ld is performed through use of an arbitrary known distance measurement method (a method in which distance measurement is performed using a laser sensor or a method in which distance measurement is performed through image processing).

Next, as shown in FIG. 4(*b*), a moving amount D1 of the first welding electrode WE1 is calculated (step S230), and the first welding electrode WE1 is moved toward the ground electrode 30 along the facing direction Df by the calculated moving amount D1 (step S240). In the present embodiment, the moving amount D1 of the first welding electrode WE1 is calculated on the assumption that the moving amount D1 is equal to the difference between the second distance Ld and the first distance Lc. Namely, the moving amount D1 is calculated in accordance with the following Equation (1).

$$D1=Ld-Lc \tag{1}$$

If the moving amount D1 of the first welding electrode WE1 is calculated in this manner, the first forward end surface ES1 of the first welding electrode WE1 moves to a position which perfectly coincides with the outer surface of the ground electrode 30. In this state, the first forward end surface ES1 supports the outer surface of the ground electrode 30 without pressing the ground electrode 30 along the facing direction Df.

Next, as shown in FIG. 4(*c*), the second welding electrode WE2 is moved toward the ground electrode 30 along the facing direction Df by a preset moving amount (fixed amount) D2 (step S250). As a result of the movement of the second welding electrode WE2, there is established a contact state in which the electrode tip 90 is in contact with both of the second forward end surface ES2 of the second welding electrode WE2 and the surface of the ground electrode 30. Further, the intermediate portion MP of the second welding electrode WE2 elastically deforms, and creates a pressing state in which the second forward end surface ES2 presses the electrode tip 90 against the surface of the ground electrode 30. Namely, the moving amount D2 of the second welding electrode WE2 is set such that such a pressing state is established as a result of movement of the second welding electrode WE2. Notably, in the pressing state, the length of the intermediate portion MP along the facing direction Df decreases from that in the initial state shown in FIG. 4(*a*).

Next, in the pressing state shown in FIG. 4(*c*), a voltage is applied between the first welding electrode WE1 and the second welding electrode WE2 so as to join the ground electrode 30 and the electrode tip 90 together by means of resistance welding (step S260). After the resistance welding, the second welding electrode WE2 is retreated to the initial position, and then the first welding electrode WE1 is also retreated to the initial position. Thus, the process of joining the electrode tip 90 to the ground electrode 30 is completed (step S270).

As described above, in the process of joining the electrode tip 90 to the ground electrode 30 in the present embodiment, the first welding electrode WE1 in contact with the ground electrode 30 and the second welding electrode WE2 in contact with the electrode tip 90 are electrically connected through the ground electrode 30 and the electrode tip 90, whereby the ground electrode 30 and the electrode tip 90 are joined together by means of resistance welding. The second welding electrode WE2 has the intermediate portion MP, which is elastically deformable along the facing direction Df. Therefore, even in the case where each component has a dimensional variation or a positional variation, the state in which the first welding electrode WE1 and the second welding electrode WE2 are electrically connected through the ground electrode 30 and the electrode tip 90 can be stably established. Therefore, in the present embodiment, the resistance welding for joining the ground electrode 30 and the electrode tip 90 can be performed under a stable condition, whereby lowering of joint strength can be suppressed. More specifically, in the present embodiment, the electrode tip 90 is joined to the ground electrode 30 by means of resistance welding in a state in which the surface (outer surface) of the ground electrode 30 opposite the side to which the electrode tip 90 is to be joined is supported by the first forward end surface ES1 of the first welding electrode WE1, and the ground electrode 30 and the electrode tip 90 are sandwiched between the first welding electrode WE1 and the second welding electrode WE2. The second welding electrode WE2 has the intermediate portion MP, which is elastically deformable along the facing direction Df. Therefore, even in the case where each component has a dimensional variation or a positional variation, when the ground electrode 30 and the electrode tip 90 are sandwiched between the first welding electrode WE1 and the second welding electrode WE2, the electrode tip 90 comes into contact with both of the second forward end surface ES2 of the second welding electrode WE2 and the surface of the ground electrode 30. Also, there can be stably established a pressing state in which the second forward end surface ES2 of the second welding electrode WE2 presses the electrode tip 90 against the surface of the ground electrode 30. Accordingly, in the present embodiment, the resistance welding for joining the ground electrode 30 and the electrode tip 90 can be performed under a stable condition, whereby lowering of joint strength can be suppressed.

Also, in the process of joining the electrode tip 90 to the ground electrode 30 in the present embodiment, after the outer surface of the ground electrode 30 is supported by the first forward end surface ES1 of the first welding electrode WE1, the second welding electrode WE2 is moved toward the ground electrode 30 so as to sandwich the ground electrode 30 and the electrode tip 90 between the first welding electrode WE1 and the second welding electrode WE2. Therefore, a stable pressing state can be established easily and reliably, whereby lowering of joint strength can be suppressed.

Also, in the process of joining the electrode tip 90 to the ground electrode 30 in the present embodiment, the first distance Lc (along the facing direction Df) between the reference point AP and the outer surface of the ground electrode 30 is measured, the second distance Ld (along the facing direction Df) between the reference point AP and the first forward end surface ES of the first welding electrode WE1 is acquired, and the first welding electrode WE1 is moved by the moving amount D1 equal to the difference between the second distance Ld and the first distance Lc. Therefore, the first forward end surface ES1 of the first welding electrode WE1 moves to a position which perfectly coincides with the outer surface of the ground electrode 30, and the first forward end surface ES1 supports the outer surface of the ground electrode 30 without pressing the ground electrode 30 along the facing direction Df. Accordingly, in the present embodiment, when resistance welding is performed, there can be established a state in which almost the entirety of the first forward end surface ES1 of the first welding electrode WE1 is in contact with the outer surface of the ground electrode 30, and almost the entirety of the surface of the electrode tip 90 is in contract with the surface of the ground electrode 30. Therefore, the ground electrode 30 and the electrode tip 90 come into stable contact with the forward end surfaces ES of the corresponding welding electrodes WE. Accordingly, in the present embodiment, resistance welding can be performed under a stable condition, and lowering of joint strength can be suppressed.

Figure 5:
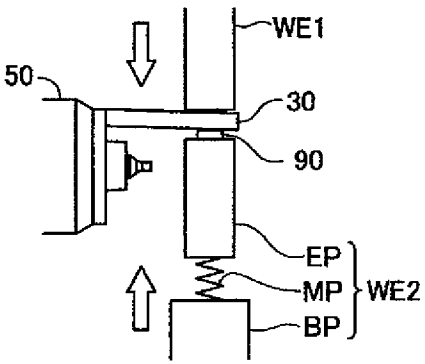
FIG. 5 illustrates explanatory views showing a method of joining the electrode tip 90 to the ground electrode 30 in a comparative example.
Figure 5:
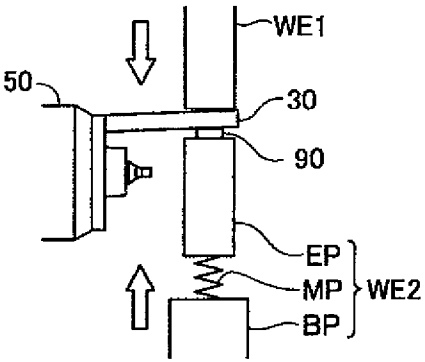

FIG. 5 is a set of explanatory views showing a method of joining the electrode tip 90 to the ground electrode 30 in a comparative example. FIG. 5(*a*) shows the case where the moving amount of the first welding electrode WE1 is excessively large. If the moving amount of the first welding electrode WE1 is excessively large, the first forward end surface ES1 of the first welding electrode WE1 presses the ground electrode 30 along the facing direction Df. In such a case, when a pressing state in which the first welding electrode WE1 and the second welding electrode WE2 sandwich the ground electrode 30 and the electrode tip 90 is established as a result of subsequent movement of the second welding electrode WE2, a portion of the first forward end surface ES1 of the first welding electrode WE1 may fail to come into contact with the surface of the ground electrode 30, and a portion of the surface of the electrode tip 90 may fail to come into contact with the surface of the ground electrode 30. Accordingly, in this case, since the state of contact between the ground electrode 30 and the electrode tip 90 and the forward end surfaces ES of the corresponding welding electrodes WE is unstable, welding is not performed under a stable condition. Therefore, lowering of joint strength cannot be suppressed. FIG. 5(*b*) shows the case where the moving amount of the first welding electrode WE1 is excessively small. If the moving amount of the first welding electrode WE1 is excessively small, the first forward end surface ES1 of the first welding electrode WE1 does not reach the position corresponding to the outer surface of the ground electrode 30, and a gap is formed between the first forward end surface ES1 and the surface of the ground electrode 30. In such a case as well, when a pressing state in which the first welding electrode WE1 and the second welding electrode WE2 sandwich the ground electrode 30 and the electrode tip 90 is established as a result of subsequent movement of the second welding electrode WE2, a portion of the first forward end surface ES1 of the first welding electrode WE1 may fail to come into contact with the outer surface of the ground electrode 30, and a portion of the surface of the electrode tip 90 may fail to come into contact with the surface of the ground electrode 30. Accordingly, in this case as well, since the state of contact between the ground electrode 30 and the electrode tip 90 and the forward end surfaces ES of the corresponding welding electrodes WE is unstable, welding is not performed under a stable condition. Therefore, lowering of joint strength cannot be suppressed. In the present embodiment, since the first welding electrode WE1 is moved by the moving amount D1 equal to the difference between the second distance Ld and the first distance Lc, the first forward end surface ES1 of the first welding electrode WE1 moves to a position which perfectly coincides with the outer surface of the ground electrode 30. Therefore, the state of contact between the ground electrode 30 and the electrode tip 90 and the forward end surfaces ES of the corresponding welding electrodes WE can be improved, whereby lowering of joint strength can be suppressed.

Figure 6:
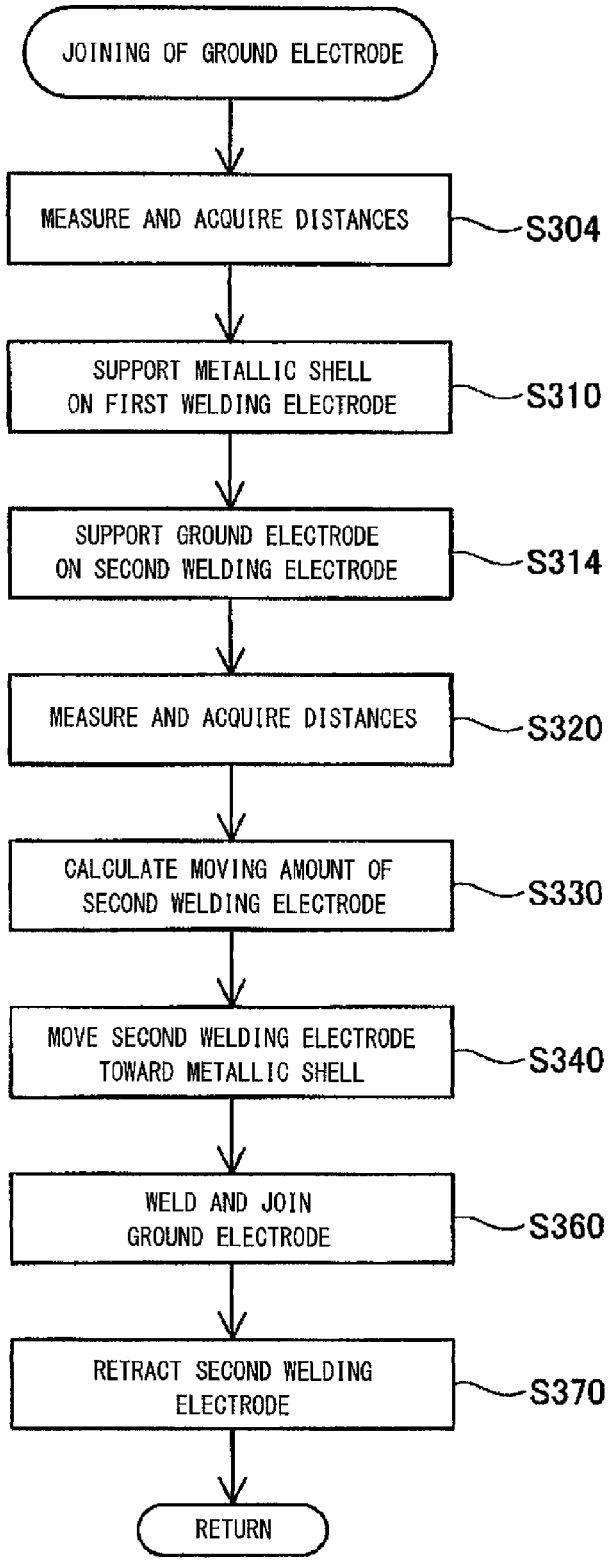
FIG. 6 is a flowchart showing a method of joining the ground electrode 30 to a metallic shell 50 in the present embodiment.
Figure 7:
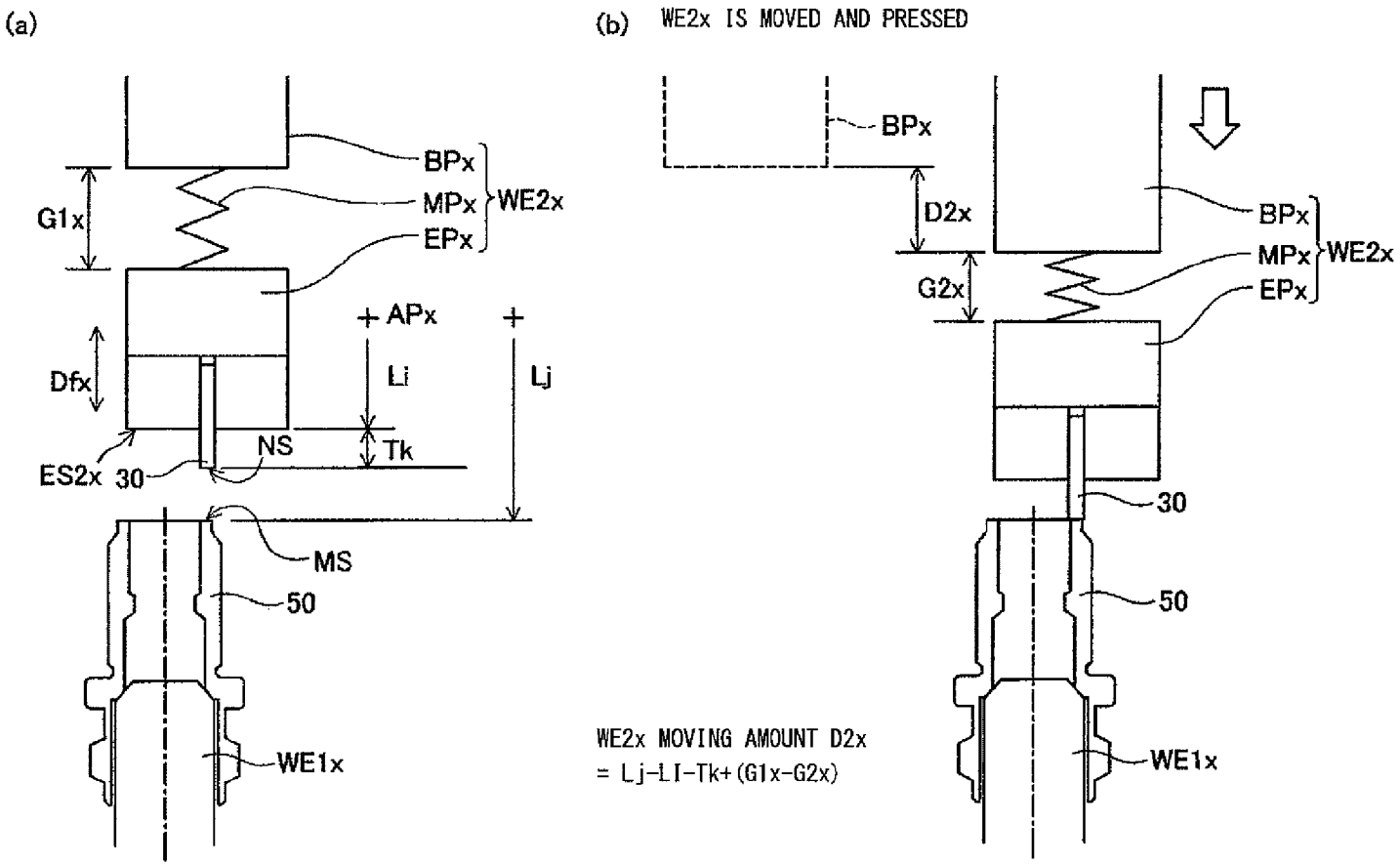
FIG. 7 illustrates explanatory views showing the method of joining the ground electrode 30 to the metallic shell 50 in the present embodiment.

A-4. Method of Joining the Ground Electrode to the Metallic Shell:

FIG. 6 is a flowchart showing a method of joining the ground electrode 30 to the metallic shell 50 in the present embodiment. FIG. 7 is a set of explanatory views showing the method of joining the ground electrode 30 to the metallic shell 50 in the present embodiment. Notably, in the process of joining the ground electrode 30 to the metallic shell 50, the metallic shell 50 corresponds to the first member of the present invention, and the ground electrode 30 corresponds to the second member of the present invention.

The ground electrode 30 is joined to the metallic shell 50 by means of resistance welding which is performed using a pair of welding electrodes (a first welding electrode WE1*x* and a second welding electrode WE2*x*) (see FIG. 7(*a*)). The first welding electrode WE1*x* supports the metallic shell 50 on the side opposite a joint surface MS of the metallic shell 50 to which the ground electrode 30 is to be joined. The second welding electrode WE2*x* chucks (holds) a portion of the side surfaces of the ground electrode 30 located opposite a joint surface NS thereof which is to be joined to the metallic shell 50. The first welding electrode WE1*x* and the second welding electrode WE2*x* are disposed such that the joint surface MS of the metallic shell 50 and the joint surface NS of the ground electrode 30 face each other in a state in which the first welding electrode WE1*x* supports the metallic shell 50 and the second welding electrode WE2*x* chucks the ground electrode 30. The direction in which these surfaces face each other will be referred to as the "facing direction Dfx." The second welding electrode WE2*x* includes a forward end portion EPx having a portion for chucking the ground electrode 30; a support portion BPx; and an intermediate portion MPx which is located between the forward end portion EPx and the support portion BPx and is elastically deformable along the facing direction Dfx. The second welding electrode WE2*x* can reciprocate along the facing direction Dfx. Notably, in the following description, the moving amount D2*x* of the second welding electrode WE2*x* refers to the moving amount of the support portion BPx of the second welding electrode WE2*x*.

In an initial state before the ground electrode 30 is chucked by the second welding electrode WE2*x*, a distance (fifth distance) Li between a preset reference point APx and the forward end surface ES2*x* of the second welding electrode WE2*x* along the facing direction Dfx is obtained (measured) by an arbitrary known distance measurement method (step S304). The forward end surface ES2*x* is a surface of the second welding electrode WE2*x* which faces the first welding electrode WE1*x*. In the present embodiment, the fifth distance Li is measured at the beginning of the manufacturing process and is stored in a predetermined storage area. The fifth distance Li is obtained by reading out the stored fifth distance Li. However, the fifth distance Li may be obtained by measuring it every time.

Next, as shown in FIG. 7(*a*), the metallic shell 50 is supported by the first welding electrode WE1*x* (step S310), and the ground electrode 30 is chucked by the second welding electrode WE2*x* (step S314). In this state, the joint surface MS of the metallic shell 50 and the joint surface NS of the ground electrode 30 face each other with a space formed therebetween.

Next, a distance (fourth distance) Lj (along the facing direction Dfx) between the reference point APx and the joint surface MS of the metallic shell 50 is obtained (measured) by an arbitrary known distance measurement method, and a distance (sixth distance) Tk (along the facing direction Dfx) between the forward end surface ES2*x* of the second welding electrode WE2*x* and the joint surface NS of the ground electrode 30 is acquired (step S320). In the present embodiment, an assumed value is stored in a predetermined storage area in advance, and the stored value is acquired as the sixth distance Tk. Notably, the fifth distance Li and the sixth distance Tk correspond to a correction value which is acquired from the positional information of the ground electrode 30 (the second member) and is used to render constant the load for resistance welding the ground electrode 30 and the metallic shell 50 together.

Next, as shown in FIG. 7(*b*), a moving amount D2*x* of the second welding electrode WE2*x* is calculated (step S330). The moving amount D2*x* of the second welding electrode WE2*x* is set on the basis of a value obtained by subtracting the sixth distance Tk from the difference between the fourth distance Lj and the fifth distance Li. Specifically, as represented by the following Equation (4), the moving amount D2*x* is calculated under the assumption that the moving amount D2*x* is equal to a moving amount obtained by adding a moving amount (G1*x*−G2*x*) which corresponds to a target deformation amount of the intermediate portion MPx in the pressing state to a value obtained by subtracting the sixth distance Tk from the difference ($L_j$−$L_1$) between the fourth distance Lj and the fifth distance Li. The moving amount (G1*x*−G2*x*) which corresponds to the target deformation amount of the intermediate portion MPx in a pressing state is the difference between the length G1*x* (along the facing direction Dfx) of the intermediate portion MPx in the initial state and the target length G2*x* of the intermediate portion MPx in the pressing state.

$$D2x=Lj-Li-Tk+(G1x-G2x) \quad (4)$$

After the calculation of the moving amount D2*x* of the second welding electrode WE2*x*, the second welding electrode WE2*x* is moved toward the ground electrode 30 along the facing direction Dfx by the calculated moving amount D2*x* (step S340). As a result of the movement of the second welding electrode WE2*x*, as shown in FIG. 7(*b*), there is established a contact state in which the joint surface NS of the ground electrode 30 is in contact with the joint surface MS of the metallic shell 50. Further, the intermediate portion MPx of the second welding electrode WE2*x* elastically deforms and establishes a pressing state in which and the second welding electrode WE2*x* presses the ground electrode 30 against the joint surface MS of the metallic shell 50.

Next, in the pressing state shown in FIG. 7(*b*), a voltage is applied between the first welding electrode WE1*x* and the second welding electrode WE2*x* so as to join the metallic shell 50 and the ground electrode 30 together by means of resistance welding (step S360). After the resistance welding, the second welding electrode WE2*x* is retreated to the initial position. Thus, the process of joining the ground electrode 30 to the metallic shell 50 is completed (step S370). Notably, the operation of calculating the moving amount D2*x* of the second welding electrode WE2*x* on the basis of the fifth distance Li and the sixth distance Tk and moving the second welding electrode WE2*x* by the calculated moving amount D2*x* corresponds to the operation of adjusting the load for resistance welding (such that the load becomes constant) by using the fifth distance Li and the sixth distance Tk, which serve as a correction value.

As described above, in the process of joining the ground electrode 30 to the metallic shell 50 in the present embodiment, the first welding electrode WE1$x$ in contact with the metallic shell 50 and the second welding electrode WE2$x$ in contact with the ground electrode 30 are electrically connected through the metallic shell 50 and the ground electrode 30, whereby the metallic shell 50 and the ground electrode 30 are joined together by means of resistance welding. The second welding electrode WE2$x$ has the intermediate portion MPx, which is elastically deformable along the facing direction Dfx. Therefore, even in the case where each component has a dimensional variation or a positional variation, the state in which the first welding electrode WE1$x$ and the second welding electrode WE2$x$ are electrically connected through the metallic shell 50 and the ground electrode 30 can be stably established. Therefore, in the present embodiment, the resistance welding for joining the metallic shell 50 and the ground electrode 30 can be performed under a stable condition, whereby lowering of joint strength can be suppressed. More specifically, in the process of joining the ground electrode 30 to the metallic shell 50 in the present embodiment, the first welding electrode WE1$x$, which supports the metallic shell 50 on the side opposite the side to which the ground electrode 30 is to be joined, and the second welding electrode WE2$x$, which chucks the ground electrode 30 at the side surfaces thereof, are electrically connected through the metallic shell 50 and the ground electrode 30, whereby the metallic shell 50 and the ground electrode 30 are joined together by means of resistance welding. The second welding electrode WE2$x$ has the intermediate portion MPx, which is elastically deformable along the facing direction Dfx. Therefore, even in the case where each component has a dimensional variation or a positional variation, there can be stably established a pressing state in which the ground electrode 30 chucked by the second welding electrode WE2$x$ is pressed against the metallic shell 50 supported by the first welding electrode WE1$x$. Accordingly, in the present embodiment, the resistance welding for joining the metallic shell 50 and the ground electrode 30 can be performed under a stable condition, whereby lowering of joint strength can be suppressed.

Also, in the process of joining the ground electrode 30 to the metallic shell 50 in the present embodiment, the second welding electrode WE2$x$, which chucks the ground electrode 30, is moved toward the metallic shell 50 supported by the first welding electrode WE1$x$, whereby the metallic shell 50 and the ground electrode 30 are sandwiched between the first welding electrode WE1$x$ and the second welding electrode WE2$x$. Therefore, a stable pressing state can be established easily and reliably, whereby lowering of joint strength can be suppressed.

Also, in the process of joining the ground electrode 30 to the metallic shell 50 in the present embodiment, the fourth distance Lj (along the facing direction Gfx) between the reference point APx and the joint surface MS of the metallic shell 50 is measured, the fifth distance Li (along the facing direction Dfx) between the reference point APx and the forward end surface ES2$x$ of the second welding electrode WE2$x$ is acquired, and the second welding electrode WE2$x$ is moved toward the metallic shell 50 such that the support portion BPx is moved by the moving amount D2$x$ set on the basis of the difference between the fourth distance Lj and the fifth distance Li. After that, the metallic shell 50 and the ground electrode 30 are joined through welding by applying a voltage between the first welding electrode WE1$x$ and the second welding electrode WE2$x$. Therefore, there can be more reliably established a pressing state in which the second welding electrode WE2$x$ presses the ground electrode 30 against the joint surface MS of the metallic shell 50, whereby lowering of joint strength can be suppressed.

More specifically, in the process of joining the ground electrode 30 to the metallic shell 50 in the present embodiment, the sixth distance Tk (along the facing direction Dfx) between the forward end surface ES2$x$ of the second welding electrode WE2$x$ and the joint surface NS of the ground electrode 30 chucked by the second welding electrode WE2$x$ is acquired, and the moving amount D2$x$ of the second welding electrode WE2$x$ is set on the basis of a value obtained by subtracting the sixth distance Tk from the difference between the fourth distance Lj and the fifth distance Li. Therefore, the pressing state in which the second welding electrode WE2$x$ presses the ground electrode 30 against the joint surface MS of the metallic shell 50 can be established more reliably, whereby lowering of joint strength can be suppressed.

Also, in the present embodiment, the moving amount D2$x$ of the second welding electrode WE2$x$ is set to a sufficiently large amount such that a contact state in which the ground electrode 30 chucked by the second welding electrode WE2$x$ is in contact with the metallic shell 50 is established, and the intermediate portion MPx of the second welding electrode WE2$x$ elastically deforms to establish a pressing state in which the second welding electrode WE2$x$ presses the ground electrode 30 against the metallic shell 50. Therefore, the pressing state in which the second welding electrode WE2$x$ presses the ground electrode 30 against the joint surface MS of the metallic shell 50 can be established more reliably, and lowering of joint strength can be suppressed.

Also, in the present embodiment, the moving amount D2$x$ of the second welding electrode WE2$x$ is set to a moving amount obtained by adding a moving amount (G2$x$−G1$x$) corresponding to the target deformation amount of the intermediate portion MPx in the pressing state to a value obtained by subtracting the sixth distance Tk from the difference between the fourth distance Lj and the fifth distance Li. Therefore, the deformation amount G1$x$−G2$x$) of the intermediate portion MPx of the second welding electrode WE2$x$ in the pressing state can be rendered constant, and the compression force in the pressing state can be rendered constant.

Accordingly, in the present embodiment, the compression force at the time of resistance welding the metallic shell 50 and the ground electrode 30 together can be rendered constant so as to render the welding condition more stable, whereby lowering of joint strength can be suppressed satisfactorily.

B. Second Embodiment

Figure 8:
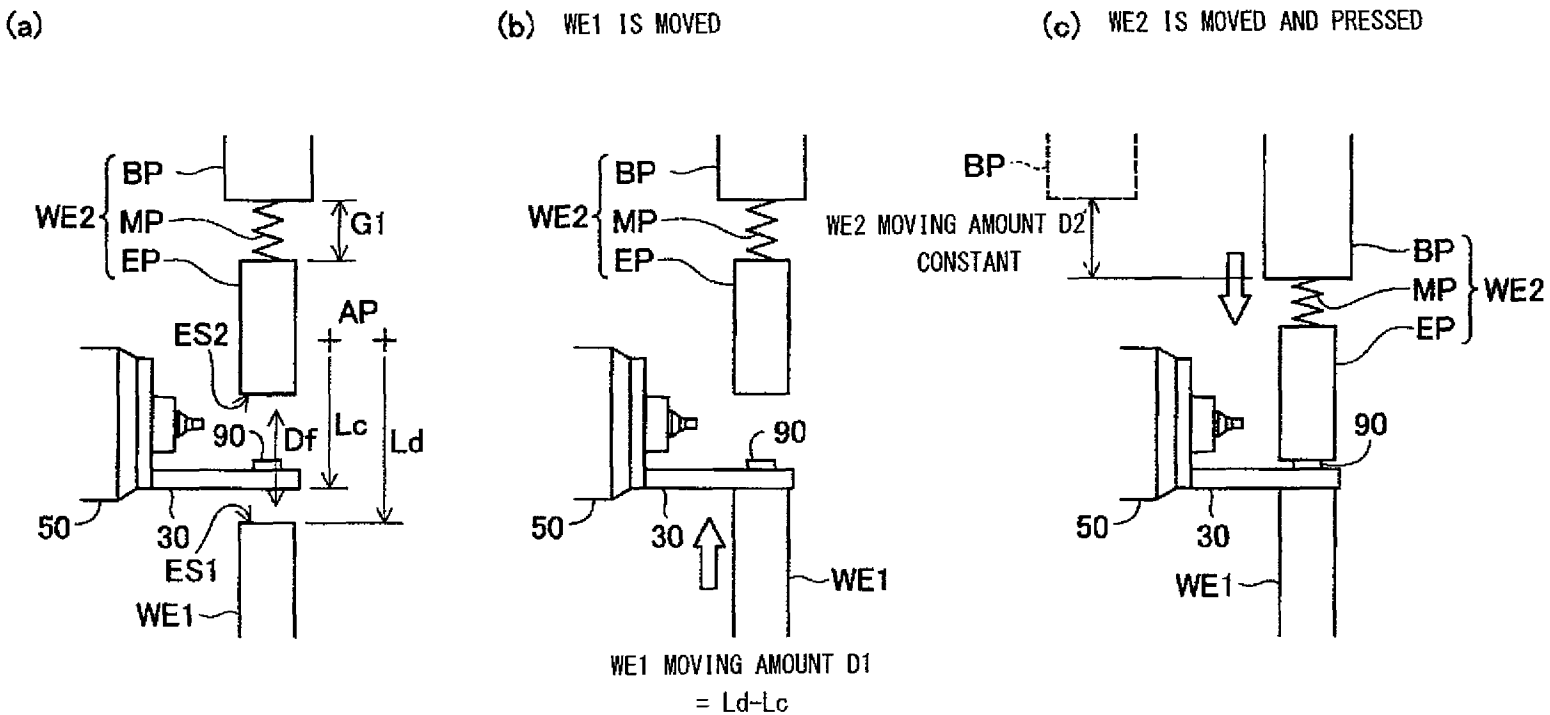
FIG. 8 illustrates explanatory views showing the method of joining the electrode tip 90 to the ground electrode 30 in a second embodiment.

FIG. 8 is a set of explanatory views showing the method of joining the electrode tip 90 to the ground electrode 30 in a second embodiment. In the second embodiment, the positional relation between the first welding electrode WE1 and the second welding electrode WE2 in the initial state is reverse to that in the first embodiment shown in FIG. 4. Namely, as shown in FIG. 8(*a*), the first welding electrode WE1 is located on the lower side, and the second welding electrode WE2 is located on the upper side.

The process of joining the electrode tip 90 to the ground electrode 30 in the second embodiment is performed in a manner similar to that in the first embodiment. First, the ground electrode 30 is fixed. The fixing of the ground electrode 30 is performed such that a region of the ground electrode 30 to which the electrode tip 90 is to be joined is located within the space between the first forward end surface ES1 and the second forward end surface ES2 and faces the second forward end surface ES2. Notably, in the second embodiment, the electrode tip 90 before being welded is placed in the region of the ground electrode 30 to which the electrode tip 90 is to be joined.

Next, as shown in FIG. 8(*a*), the first distance Lc (along the facing direction Df) between the reference point AP and the outer surface of the ground electrode 30 is measured, and the second distance Ld (along the facing direction Df) between the reference point AP and the first forward end surface ES1 of the first welding electrode WE1 is acquired. Subsequently, as shown in FIG. 8(*b*), the first welding electrode WE1 is moved toward the ground electrode 30 along the facing direction Df by the moving amount D1 equal to the difference between the second distance Ld and the first distance Lc.

Next, as shown in FIG. 8(*c*), the second welding electrode WE2 is moved toward the ground electrode 30 along the facing direction Df by a preset moving amount (fixed amount) D2. As a result of the movement of the second welding electrode WE2, there is established a contact state in which the electrode tip 90 is in contact with both of the second forward end surface ES2 of the second welding electrode WE2 and the surface of the ground electrode 30. Further, the intermediate portion MP of the second welding electrode WE2 elastically deforms, and establishes a pressing state in which the second forward end surface ES2 presses the electrode tip 90 against the surface of the ground electrode 30. Next, in the pressing state, a voltage is applied between the first welding electrode WE1 and the second welding electrode WE2 so as to join the ground electrode 30 and the electrode tip 90 together by means of resistance welding. After the resistance welding, the second welding electrode WE2 is retreated to the initial position, and then the first welding electrode WE1 is also retreated to the initial position.

As described above, in the process of joining the electrode tip 90 to the ground electrode 30 in the second embodiment, as in the first embodiment, the electrode tip 90 is joined to the ground electrode 30 by means of resistance welding in a state in which the surface (outer surface) of the ground electrode 30 opposite the side to which the electrode tip 90 is to be joined is supported by the first forward end surface ES1 of the first welding electrode WE1, and the ground electrode 30 and the electrode tip 90 are sandwiched between the first welding electrode WE1 and the second welding electrode WE2. Therefore, there can be stably established a pressing state in which the second forward end surface ES2 of the second welding electrode WE2 presses the electrode tip 90 against the surface of the ground electrode 30. Accordingly, the resistance welding for joining the ground electrode 30 and the electrode tip 90 can be performed under a stable condition, whereby lowering of joint strength can be suppressed.

Also, in the process of joining the electrode tip 90 to the ground electrode 30 in the second embodiment, as in the first embodiment, after the outer surface of the ground electrode 30 is supported by the first forward end surface ES1 of the first welding electrode WE1, the second welding electrode WE2 is moved toward the ground electrode 30, whereby the ground electrode 30 and the electrode tip 90 are sandwiched between the first welding electrode WE1 and the second welding electrode WE2. Therefore, a stable pressing state can be established easily and reliably, whereby lowering of joint strength can be suppressed.

Also, in the process of joining the electrode tip 90 to the ground electrode 30 in the second embodiment, as in the first embodiment, the first distance Lc (along the facing direction Df) between the reference point AP and the outer surface of the ground electrode 30 is measured, the second distance Ld (along the facing direction Df) between the reference point AP and the first forward end surface ES1 of the first welding electrode WE1 is acquired, and the first welding electrode WE1 is moved by the moving amount D1 equal to the difference between the second distance Ld and the first distance Le. Therefore, the first forward end surface ES1 of the first welding electrode WE1 moves to a position which perfectly coincides with the outer surface of the ground electrode 30. Therefore, the ground electrode 30 and the electrode tip 90 come into stable contact with the forward end surfaces ES of the corresponding welding electrodes WE. Accordingly, in the present embodiment, resistance welding can be performed under a stable condition, and lowering of joint strength can be suppressed.

C. Third Embodiment

Figure 9:
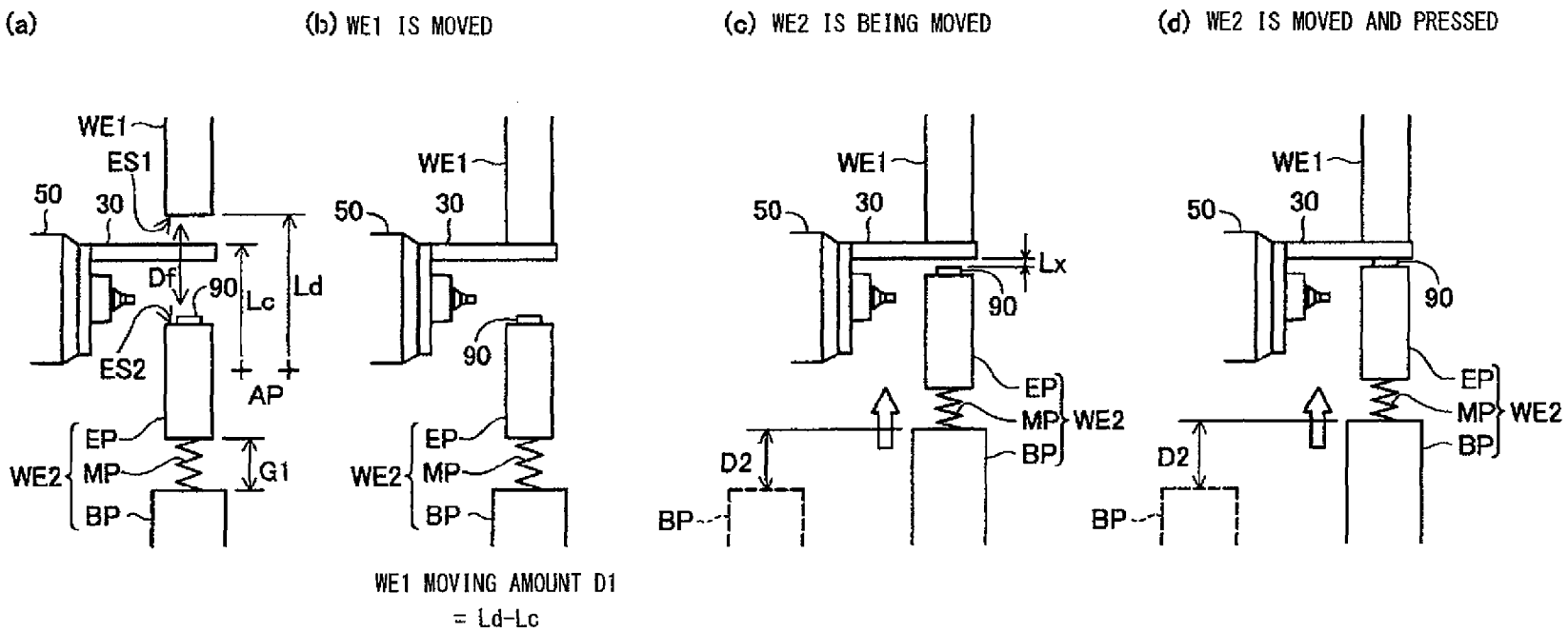
FIG. 9 illustrates explanatory views showing the method of joining the electrode tip 90 to the ground electrode 30 in a third embodiment.

FIG. 9 is a set of explanatory views showing the method of joining the electrode tip 90 to the ground electrode 30 in a third embodiment. The process of joining the electrode tip 90 to the ground electrode 30 in the third embodiment is performed in the same manner as in the first embodiment from the beginning to the movement of the first welding electrode WE1 (see FIGS. 9(*a*) and 9(*b*)).

In the third embodiment, the amount D2 of the subsequent movement of the second welding electrode WE2 is the same as that in the first embodiment. However, in the third embodiment, when second welding electrode WE2 is moved, the moving speed of the second welding electrode WE2 is reduced immediately before establishment of a contact state in which the electrode tip 90 is in contact with both of the second forward end surface ES2 of the second welding electrode WE2 and the surface of the ground electrode 30. Specifically, as shown in FIG. 9(*c*), when the distance between the surface of the ground electrode 30 and the surface (upper surface) of the electrode tip 90 disposed on the second forward end surface ES2 decreases to a small distance Lx as a result of movement of the second welding electrode WE2, the moving speed of the second welding electrode WE2 is reduced. Notably, the operation of changing the moving speed of the second welding electrode WE2 can be realized by moving the second welding electrode WE2 through use of, for example, a servo motor. After that, the second welding electrode WE2 is moved at the reduced speed until a contact state is established, and the intermediate portion MP of the second welding electrode WE2 elastically deforms to establish a pressing state in which the second forward end surface ES2 presses the electrode tip 90 against the surface of the ground electrode 30.

After establishment of such a pressing state, as in the first embodiment, a voltage is applied between the first welding electrode WE1 and the second welding electrode WE2 so as to join the ground electrode 30 and the electrode tip 90 together by means of resistance welding. Subsequently, the second welding electrode WE2 is retreated to the initial position, and then the first welding electrode WE1 is also retreated to the initial position.

As described above, in the process of joining the electrode tip 90 to the ground electrode 30 in the third embodiment, the moving speed of the second welding electrode WE2 is reduced immediately before establishment of the contact state in which the electrode tip 90 is in contact with both of the second forward end surface ES2 of the second welding electrode WE2 and the surface of the ground electrode 30. Therefore, it is possible to prevent formation of a dent on the surface of the ground electrode 30, which dent would otherwise be formed due to impact at the time of establishment of the contact state. If a dent is formed on the surface of the ground electrode 30, the state of contact between the ground electrode 30 and the electrode tip 90 at the time of resistance welding becomes unstable, and it may become difficult to stabilize the welding condition. Also, in the case where the second welding electrode WE2 is moved at a low speed from the beginning, formation of a dent on the surface of the ground electrode 30 can be suppressed. However, in such a case, the time required for the manufacturing process increases. In the third embodiment, since the moving speed of the second welding electrode WE2 is reduced immediately before establishment of the contact state, it is possible to prevent formation of a dent on the surface of the ground electrode 30 while preventing an increase in the time required for the manufacturing process. Thus, the state of contact between the ground electrode 30 and the electrode tip 90 at the time of resistance welding can be stabilized, whereby lowering of joint strength can be suppressed.

D. Fourth Embodiment

Figure 10:
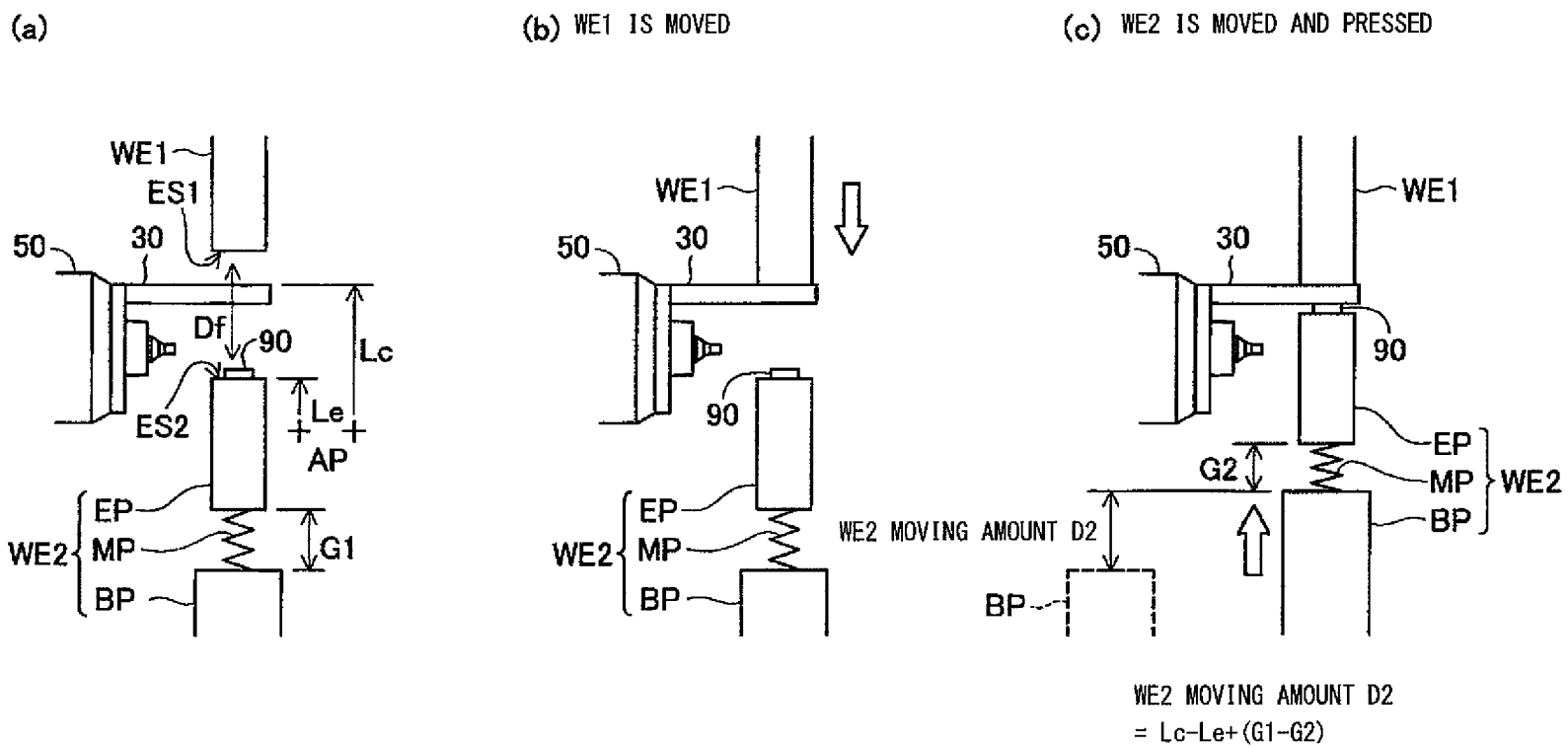
FIG. 10 illustrates explanatory views showing the method of joining the electrode tip 90 to the ground electrode 30 in a fourth embodiment.

FIG. 10 is a set of explanatory views showing the method of joining the electrode tip 90 to the ground electrode 30 in a fourth embodiment. The process of joining the electrode tip 90 to the ground electrode 30 in the fourth embodiment is performed in the same manner as in the first embodiment from the beginning to the movement of the first welding electrode WE1 (see FIGS. 10(*a*) and 10(*b*)).

In the fourth embodiment, when the second welding electrode WE2 is moved subsequently, a third distance Le (along the facing direction Df) between the reference point AP and the second forward end surface ES2 of the second welding electrode WE2 is measured, and the moving amount D2 of the second welding electrode WE2 is calculated on the basis of the third distance Le. Specifically, the moving amount D2 of the second welding electrode WE2 is calculated on the assumption that the moving amount D2 is equal to a moving amount obtained by adding a moving amount which corresponds to a target deformation amount of the intermediate portion MP in the pressing state to the difference between the first distance Lc and the third distance Le. The moving amount which corresponds to the target deformation amount of the intermediate portion MP in the pressing state is the difference (G1−G2) between the length G1 (along the facing direction Df) of the intermediate portion MP in the initial state and the target length G2 of the intermediate portion MP in the pressing state. Namely, the moving distance D2 is calculated in accordance with the following Equation (2). Notably, the third distance Le corresponds to a correction value which is acquired from the positional information of the electrode tip 90 (the second member) and is used to render constant the load for resistance welding the electrode tip 90 and the ground electrode 30 together.

$$D2=Lc-Le+(G1-G2) \quad (2)$$

After the calculation of the moving amount D2 of the second welding electrode WE2, the second welding electrode WE2 is moved by the calculated moving amount D2 so as to establish the pressing state, and a voltage is applied between the first welding electrode WE1 and the second welding electrode WE2 so as to join the electrode tip 90 and the ground electrode 30 together by means of resistance welding. After the resistance welding, the second welding electrode WE2 is retreated to the initial position and then the first welding electrode WE1 is retreated to the initial position. Notably, the operation of calculating the moving amount D2 of the second welding electrode WE2 on the basis of the third distance Le and moving the second welding electrode WE2 by the calculated moving amount D2 corresponds to the operation of adjusting the load for resistance welding (such that the load becomes constant) by using the third distance Le, which serves as a correction value.

As described above, in the process of joining the electrode tip 90 to the ground electrode 30 in the fourth embodiment, the moving amount D2 of the second welding electrode WE2 is calculated on the assumption that the moving amount D2 is equal to a moving amount obtained by adding the moving amount which corresponds to the target deformation amount of the intermediate portion MP in the pressing state to the difference between the first distance Lc and the third distance Le; and the second welding electrode WE2 is moved by the calculated moving amount D2, whereby the pressing state is established. Therefore, in the fourth embodiment, the deformation amount (=G1−G2) of the intermediate portion MP of the second welding electrode WE2 in the pressing state can be rendered constant, whereby the compression force in the pressing state can be rendered constant. Accordingly, in the fourth embodiment, the compression force at the time of resistance welding the ground electrode 30 and the electrode tip 90 together can be rendered constant so as to render the welding condition more stable, whereby lowering of joint strength can be suppressed satisfactorily.

E. Fifth Embodiment

Figure 11:
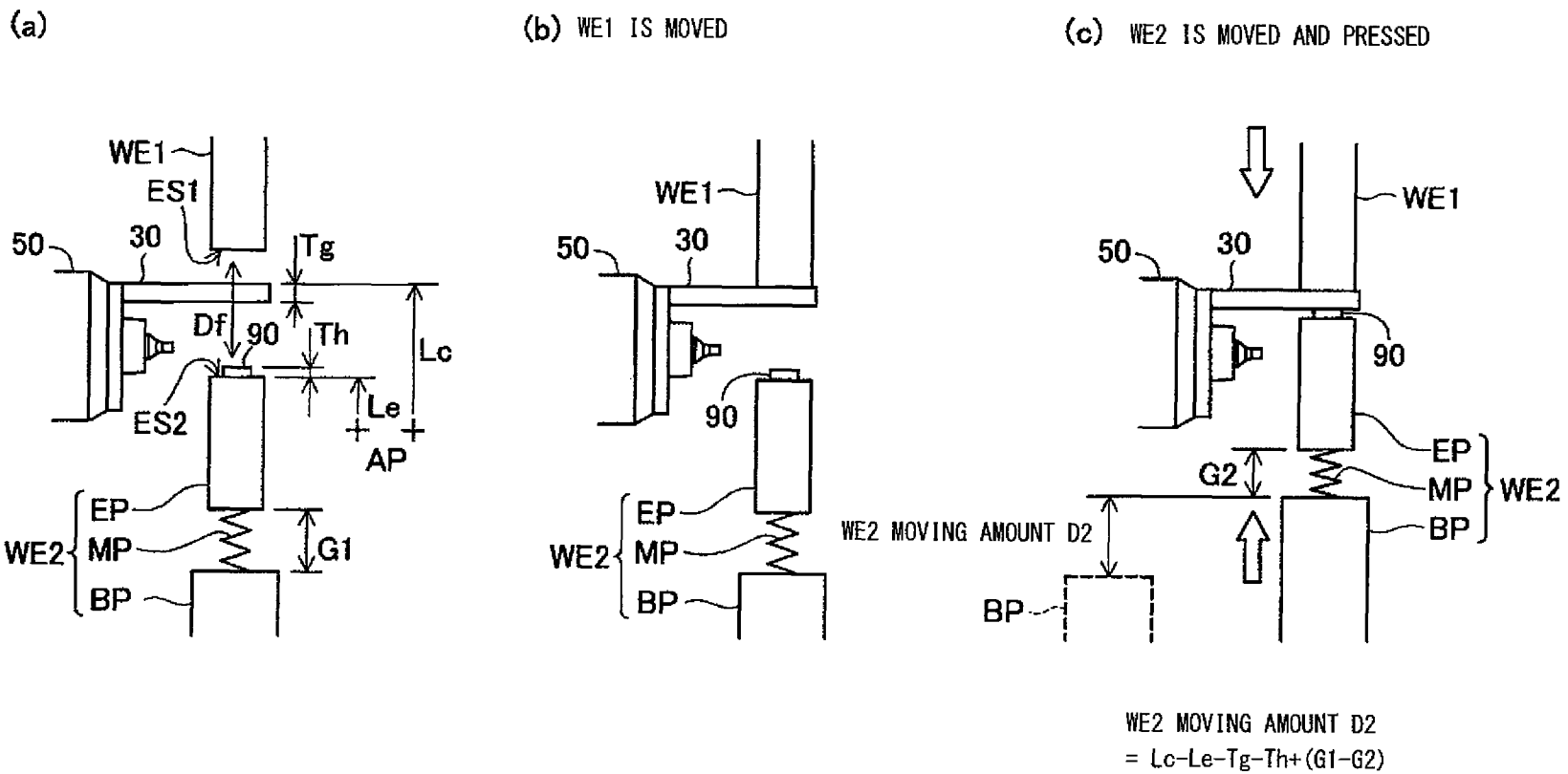
FIG. 11 illustrates explanatory views showing the method of joining the electrode tip 90 to the ground electrode 30 in a fifth embodiment.

FIG. 11 is a set of explanatory views showing the method of joining the electrode tip 90 to the ground electrode 30 in a fifth embodiment. The process of joining the electrode tip 90 to the ground electrode 30 in the fifth embodiment is performed in the same manner as in the first embodiment from the beginning to the movement of the first welding electrode WE1 (see FIGS. 11(*a*) and 11(*b*)).

In the fifth embodiment, when the second welding electrode WE2 is moved subsequently, as in the fourth embodiment, the third distance Le (along the facing direction Df) between the reference point AP and the second forward end surface ES2 of the second welding electrode WE2 is measured. In addition, in the fifth embodiment, the dimension Tg of the ground electrode 30 along the facing direction Df and the dimension Th of the electrode tip 90 along the facing direction Df are acquired. An arbitrary dimension acquiring method, such as entering the dimensions by a user, reading out data of the dimensions from a storage medium, or measuring the dimensions using measurement means, may be employed so as to acquire these dimensions. The movement amount D2 of the second welding electrode WE2 calculated in the same manner as in the fourth embodiment is adjusted on the basis of the dimensions Tg and Th. Specifically, the moving amount D2 of the second welding electrode WE2 is equal to a moving amount obtained by adding a moving amount (=G1−G2) which corresponds to the target deformation amount of the intermediate portion MP in the pressing state to the difference between the first distance Lc and the third distance Le, and by subtracting the sum of the dimensions Tg and Th from the resultant value. Namely, the moving distance D2 is calculated in accordance with the following Equation (3). Notably, the third distance Le and the dimension Th correspond to a correction value which is acquired from the positional information of the electrode tip 90 (the second member) and is used to render constant the load for resistance welding the electrode tip 90 and the ground electrode 30 together.

$$D2=Lc-Le-Tg-Th+(G1-G2) \quad (3)$$

After the calculation of the moving amount D2 of the second welding electrode WE2, the second welding electrode WE2 is moved by the calculated moving amount D2 so as to establish the pressing state, and a voltage is applied between the first welding electrode WE1 and the second welding electrode WE2 so as to join the electrode tip 90 and the ground electrode 30 together by means of resistance welding. After the resistance welding, the second welding electrode WE2 is retreated to the initial position and then the first welding electrode WE1 is retreated to the initial position. Notably, the operation of calculating the moving amount D2 of the second welding electrode WE2 on the basis of the third distance Le and the dimension Th and moving the second welding electrode WE2 by the calculated moving amount D2 corresponds to the operation of adjusting the load for resistance welding (such that the load becomes constant) by using the third distance Le and the dimension Th, which serve as a correction value.

As described above, in the process of joining the electrode tip 90 to the ground electrode 30 in the fifth embodiment, the moving amount D2 of the second welding electrode WE2 is calculated on the assumption that the moving amount D2 is equal to a moving amount obtained by adding the moving amount which corresponds to the target deformation amount of the intermediate portion MP in the pressing state to the difference between the first distance Lc and the third distance Le, and is adjusted by subtracting the sum of the dimensions Tg and Th therefrom. The second welding electrode WE2 is moved by the adjusted moving amount D2, whereby the pressing state is established. Therefore, in the fifth embodiment, even in the case where the dimension Tg of the ground electrode 30 and the dimension Th of the electrode tip 90 change due to a change in the type of products to be manufactured, without changing the length G1 of the intermediate portion MP in the initial state, the deformation amount (=G1−G2) of the intermediate portion MP of the second welding electrode WE2 in the pressing state can be rendered constant, whereby the compression force in the pressing state can be rendered constant. Accordingly, in the fifth embodiment, even in the case where various types of products are manufactured, the compression force at the time of resistance welding the ground electrode 30 and the electrode tip 90 together can be rendered constant easily so as to render the welding condition more stable, whereby lowering of joint strength can be suppressed satisfactorily.

F. Modifications

The present invention is not limited to the above-described examples and embodiments, and can be implemented in various forms without departing from the scope of the invention. For example, the following modifications are possible.

The structures of the spark plug 100 and its components in the above-described embodiments are mere examples and may be modified in various manners. For example, in the above-described embodiments, the ground electrode 30 has a double-layer structure. However, the structure of the ground electrode 30 is not limited thereto, and the ground electrode 30 may have a single-layer structure or a multi-layer structure including three or more layers. The materials of the ground electrode 30 and the electrode tip 90 are not limited to those described in the above-described embodiments.

In the above-described embodiments, after the manufacture and assembly of the components (the metallic shell 50, the center electrode 20, etc.) of the spark plug 100, excluding the ground electrode 30, the ground electrode 30 is joined to the metallic shell 50, and the electrode tip 90 is joined to the ground electrode 30. However, after the operation of joining the ground electrode 30 to the metallic shell 50 and joining the electrode tip 90 to the ground electrode 30, the metallic shell 50 and the remaining components may be assembled together.

In the third to fifth embodiments shown in FIGS. 9 to 11, the first welding electrode WE1 is located on the upper side and the second welding electrode WE2 is located on the lower side in the initial state, and the electrode tip 90 is disposed on the second forward end surface ES2 of the second welding electrode WE2. However, the third to fifth embodiments may be modified such that, as in the case of the second embodiment shown in FIG. 8, the first welding electrode WE1 is located on the lower side and the second welding electrode WE2 is located on the upper side in the initial state, and the electrode tip 90 is disposed on the ground electrode 30.

The fourth and fifth embodiments shown in FIGS. 10 and 11 may be modified such that the compression force acting on the ground electrode 30 and the electrode tip 90 is monitored in the process of joining the ground electrode 30 and the electrode tip 90 by means of resistance welding, and, when the compression force changes, the second welding electrode WE2 is moved along the facing direction Df by a moving amount for compensating the change in the compression force. Specifically, for example, in the case where the compression force acting on the ground electrode 30 and the electrode tip 90 decreases, the decreased compression force may be compensated (increased) by moving the second welding electrode WE2 toward the ground electrode 30 along the facing direction Df. At the time of resistance welding, the ground electrode 30 and the electrode tip 90 melt and slightly change in size, and the compression force acting on the ground electrode 30 and the electrode tip 90 may change. By means of monitoring the compression force and, when the compression force changes, moving the second welding electrode WE2 by a moving amount for compensating the change in the compression force, the compression force at the time of resistance welding the ground electrode 30 and the electrode tip 90 together can be rendered constant with high accuracy, whereby the welding condition can be stabilized further, and lowering of joint strength can be suppressed satisfactorily.

Similarly, in the process of joining the ground electrode 30 to the metallic shell 50 in the above-described embodiments, the compression force acting on the metallic shell 50 and the ground electrode 30 may be monitored, and, when the compression force changes, the second welding electrode WE2*x* may be moved along the facing direction Dfx by a moving amount compensating for the change in the compression force. Specifically, for example, in the case where the compression force acting on the metallic shell 50 and the ground electrode 30 decreases, the decreased compression force may be compensated (increased) by moving the second welding electrode WE2*x* toward the metallic shell 50 along the facing direction Dfx. At the time of resistance welding, the metallic shell 50 and the ground electrode 30 melt and slightly change in size, and the compression force acting on the metallic shell 50 and the ground electrode 30 may change. By means of monitoring the compression force and, when the compression force changes, moving the second welding electrode WE2*x* by a moving amount compensating for the change in the compression force, the compression force at the time of resistance welding the metallic shell 50 and the ground electrode 30 together can be rendered constant with high accuracy, whereby the welding condition can be stabilized further, and lowering of joint strength can be suppressed satisfactorily.

In the process of joining the ground electrode 30 to the metallic shell 50 in the above-described embodiments, when the second welding electrode WE2*x* is moved, the moving speed of the second welding electrode WE2*x* may be reduced immediately before establishment of a contact state in which the ground electrode 30 chucked by the second welding electrode WE2*x* is in contact with the metallic shell 50. In this case, it is possible to suppress formation of a dent on the surface of the metallic shell 50 or the ground electrode 30, which would otherwise be formed due to impact at the time of establishment of the contact state. If a dent is formed on the surface of the metallic shell 50 or the ground electrode 30, the state of contact between the metallic shell 50 and the ground electrode 30 at the time of resistance welding becomes unstable, and it may become difficult to stabilize the welding condition. Also, in the case where the second welding electrode WE2*x* is moved at a low speed from the beginning, formation of a dent can be suppressed. However, in such a case, the time required for the manufacturing process increases. If the moving speed of the second welding electrode WE2*x* is reduced immediately before establishment of the contact state, it is possible to prevent formation of a dent on the surface of the metallic shell 50 or the ground electrode 30 while preventing an increase in the time required for the manufacturing process. Thus, the state of contact between the metallic shell 50 and the ground electrode 30 at the time of resistance welding can be stabilized, whereby lowering of joint strength can be suppressed.

In the process of joining the ground electrode 30 to the metallic shell 50 in the above-described embodiments, for the sixth distance Tk (the distance along the facing direction Dfx between the forward end surface ES2*x* of the second welding electrode WE2*x* and the joint surface NS of the ground electrode 30 in the state in which the ground electrode 30 is chucked by the second welding electrode WE2*x*), an assumed value is stored in a predetermined storage area in advance, and the stored value is read out as the sixth distance Tk. However, the sixth distance Tk may be acquired by an arbitrary known distance measurement method. In this case, irrespective of variation of the length of the ground electrode 30 or variation of the chucking position at which the ground electrode 30 is chucked by the second welding electrode WE2*x*, there can be more stably established a state in which the first welding electrode WE1*x* and the second welding electrode WE2*x* are electrically connected through the metallic shell 50 and the ground electrode 30 and the second welding electrode WE2*x* presses the ground electrode 30 against the joint surface MS of the metallic shell 50. Therefore, lowering of joint strength can be suppressed.

In the above-described embodiments, the fifth distance Li is the distance along the facing direction Dfx between the reference point APx and the forward end surface ES2*x* of the second welding electrode WE2*x*, and the sixth distance Tk is the distance along the facing direction Dfx between the forward end surface ES2*x* of the second welding electrode WE2*x* and the joint surface NS of the ground electrode 30. However, the fifth distance Li may be the distance along the facing direction Dfx between the reference point APx and a reference position on the second welding electrode WE2*x*, and the sixth distance Tk may be the distance along the facing direction Dfx between the reference position on the second welding electrode WE2*x* and the joint surface NS of the ground electrode 30.

Of the constituent elements of the present invention in the above-described embodiments, elements other than the elements recited in the independent claim, are additional elements, and may be omitted or combined freely.

DESCRIPTION OF REFERENCE NUMERALS AND SYMBOLS

3: ceramic resistor
4: seal
5: gasket
10: ceramic insulator
12: axial hole
13: leg portion
17: forward trunk portion
18: rear trunk portion
19: center trunk portion
20: center electrode
21: covering member
25: core member
30: ground electrode
31: distal end portion
32: base end portion
40: metallic terminal
50: metallic shell
51: tool engagement portion
52: screw portion
54: seal portion
57: forward end surface
90: electrode tip
100: spark plug
WE: welding electrode
EP: forward end portion
BP: support portion
MP: intermediate portion
ES: forward end surface Having described the invention, the following is claimed:

1. A method of manufacturing a spark plug which includes a center electrode, a metallic shell, and a ground electrode having one end portion joined to a forward end portion of the metallic shell, the method comprising:

a joining step of joining a first member and a second member which constitute the spark plug, wherein, in the joining step, a first welding electrode in contact with the first member and a second welding electrode which has an elastically deformable intermediate portion and which is in contact with the second member are electrically connected through the first member and the second member, whereby the first member and the second member are joined together by resistance welding, a step of acquiring, from positional information of the second member, a correction value for rendering constant a load applied for the resistance welding; and a step of adjusting the load applied for the resistance welding by use of the correction value.

2. A method of manufacturing a spark plug according to claim 1, wherein the first member is the ground electrode, and the second member is an electrode tip which is joined to the ground electrode and forms a gap in cooperation with the center electrode;

the first welding electrode has a first forward end surface for supporting a surface of the ground electrode opposite the side to which the electrode tip is to be joined;

the second welding electrode has a second forward end surface which faces the first forward end surface and has the intermediate portion provided rearward of the second forward end surface such that the intermediate portion is elastically deformable along a facing direction in which the first forward end surface and the second forward end surface face each other; and the joining step is a step of joining the ground electrode and the electrode tip by resistance welding after sandwiching the ground electrode and the electrode tip between the first welding electrode and the second welding electrode.

3. A method of manufacturing a spark plug according to claim 2, wherein the joining step comprises a step of moving the second welding electrode toward the ground electrode after the surface of the ground electrode opposite the side to which the electrode tip is to be joined is supported by the first forward end surface of the first welding electrode, whereby the ground electrode and the electrode tip are sandwiched between the first welding electrode and the second welding electrode.

4. A method of manufacturing a spark plug according to claim 2, wherein the joining step comprises:

a step of measuring a first distance along the facing direction between a predetermined reference point and the surface of the ground electrode opposite the side to which the electrode tip is to be joined;

a step of acquiring a second distance along the facing direction between the predetermined reference point and the first forward end surface of the first welding electrode;

a step of moving the first welding electrode toward the ground electrode along the facing direction by an amount equal to the difference between the second distance and the first distance;

a step of moving the second welding electrode toward the ground electrode along the facing direction by a predetermined moving amount which is sufficiently large to establish a contact state in which the electrode tip is in contact with both of the second forward end surface of the second welding electrode and the ground electrode and to cause the intermediate portion of the second welding electrode to elastically deform so as to establish a pressing state in which the second forward end surface presses the electrode tip against the ground electrode; and a step of applying a voltage between the first welding electrode and the second welding electrode in the pressing state, to thereby weld the electrode tip and the ground electrode together.

5. A method of manufacturing a spark plug according to claim 4, wherein the step of moving the second welding electrode comprises a step of reducing a moving speed of the second welding electrode immediately before establishment of the contact state.

6. A method of manufacturing a spark plug according to claim 4, wherein the joining step further comprises a step of measuring a third distance along the facing direction between the predetermined reference point and the second forward end surface of the second welding electrode;

the intermediate portion of the second welding electrode has a support portion which is adjacently provided on the side opposite the second forward end surface; and the step of moving the second welding electrode is a step of moving the support portion by a moving amount which is obtained by adding to the difference between the first distance and the third distance a moving amount corresponding to a target deformation amount of the intermediate portion in the pressing state.

7. A method of manufacturing a spark plug according to claim 6, wherein the joining step further comprises a step of acquiring dimensions of the ground electrode and the electrode tip along the facing direction; and the step of moving the second welding electrode comprises a step of adjusting the moving amount on the basis of the dimensions.

8. A method of manufacturing a spark plug according to claim 6, wherein the joining step further comprises a step of monitoring a pressing force acting on the ground electrode and the electrode tip at the time of the welding, and a step of, when the compression force changes, moving the second welding electrode along the facing direction by a moving amount for compensating a change in the compression force.

9. A method of manufacturing a spark plug according to claim 1, wherein the first member is the metallic shell, and the second member is the ground electrode;

the first welding electrode supports the metallic shell on the side opposite the side to which the ground electrode is to be joined;

the second welding electrode chucks the ground electrode at a side surface thereof; and the joining step is a step in which the first welding electrode and the second welding electrode are electrically connected through the metallic shell and the ground electrode, whereby the metallic shell and the ground electrode are joined by resistance welding.

10. A method of manufacturing a spark plug according to claim 9, wherein the joining step comprises a step of moving the second welding electrode, which chucks the ground electrode, toward the metallic shell supported by the first welding electrode, whereby the metallic shell and the ground electrode are sandwiched between the first welding electrode and the second welding electrode.

11. A method of manufacturing a spark plug according to claim 9, wherein the intermediate portion of the second welding electrode has a support portion which is adjacently provided on the side opposite a portion for chucking the ground electrode; and the joining step comprises:

a step of measuring a fourth distance between a predetermined reference point and a surface of the metallic shell to which the ground electrode is to be joined, the fourth distance being measured along a facing direction in which the ground electrode and the metallic shell face each other;

a step of acquiring a fifth distance along the facing direction between the predetermined reference point and a predetermined reference position on the second welding electrode;

a step of moving the second welding electrode toward the metallic shell along the facing direction such that the support portion moves by a moving amount set on the basis of the difference between the fourth distance and the fifth distance; and a step of applying a voltage between the first welding electrode and the second welding electrode after the movement of the second welding electrode, to thereby weld the metallic shell and the ground electrode together.

12. A method of manufacturing a spark plug according to claim 11, wherein the joining step comprises a step of measuring a sixth distance along the facing direction between the predetermined reference position on the second welding electrode and a forward end surface of the ground electrode chucked by the second welding electrode; and the moving amount is set on the basis of a value obtained by subtracting the sixth distance from the difference between the fourth distance and the fifth distance.

13. A method of manufacturing a spark plug according to claim 12, wherein the moving amount is sufficiently large to establish a contact state in which the ground electrode chucked by the second welding electrode is in contact with the metallic shell and to cause the intermediate portion of the second welding electrode to elastically deform so as to establish a pressing state in which the second welding electrode presses the ground electrode against the metallic shell.

14. A method of manufacturing a spark plug according to claim 13, wherein the step of moving the second welding electrode comprises a step of reducing a moving speed of the second welding electrode immediately before establishment of the contact state.

15. A method of manufacturing a spark plug according to claim 13, wherein the step of moving the second welding electrode is a step of moving the support portion by a moving amount which is obtained by subtracting the sixth distance from the difference between the fourth distance and the fifth distance and adding to the resultant value a moving amount corresponding to a target deformation amount of the intermediate portion in the pressing state.

16. A method of manufacturing a spark plug according to claim 15, wherein the joining step further comprises a step of monitoring a pressing force acting on the metallic shell and the ground electrode at the time of the welding, and a step of, when the compression force changes, moving the second welding electrode along the facing direction by a moving amount compensating for a change in the compression force.

* * * * *

UNITED STATES PATENT AND TRADEMARK OFFICE

CERTIFICATE OF CORRECTION

PATENT NO. : 8,641,468 B2
APPLICATION NO. : 13/977931
DATED : February 4, 2014
INVENTOR(S) : Tanaka et al.

It is certified that error appears in the above-identified patent and that said Letters Patent is hereby corrected as shown below:

On the Title Page, Item (73) Assignee, line 1 the assignee identified as "NGK Spark Plug., Ltd., Aichi (JP)" should read --NGK Spark Plug Co., Ltd., Aichi (JP)--.

Signed and Sealed this
Twenty-second Day of April, 2014

Michelle K. Lee

Michelle K. Lee
*Deputy Director of the United States Patent and Trademark Office*